US010040117B2

(12) United States Patent
Vinet

(10) Patent No.: US 10,040,117 B2
(45) Date of Patent: Aug. 7, 2018

(54) CONTAMINANT-PURGING COLD CHAMBER DIE CASTING APPARATUS AND METHOD

(71) Applicant: Vinet Micro-Technologies Inc., Vaudreuil-Dorion (CA)

(72) Inventor: Alain Vinet, Vaudreuil-Dorion (CA)

(73) Assignee: Vinet Micro-Technologies Inc., Vaudreuil-Dorion, QC (CA)

( * ) Notice: Subject to any disclaimer, the term of this patent is extended or adjusted under 35 U.S.C. 154(b) by 0 days.

(21) Appl. No.: 15/707,054

(22) Filed: Sep. 18, 2017

(65) Prior Publication Data

US 2018/0185911 A1 Jul. 5, 2018

Related U.S. Application Data

(60) Provisional application No. 62/440,043, filed on Dec. 29, 2016.

(51) Int. Cl.

| | |
|---|---|
| ***B22D 17/20*** | (2006.01) |
| ***B22D 17/24*** | (2006.01) |
| ***B22D 17/14*** | (2006.01) |
| ***B22D 17/22*** | (2006.01) |

(Continued)

(52) U.S. Cl.

CPC ..... *B22D 17/24* (2013.01); *B22D 17/14* (2013.01); *B22D 17/2053* (2013.01); *B22D 17/2236* (2013.01); *B22D 17/04* (2013.01); *B22D 17/203* (2013.01); *B22D 17/2227* (2013.01); *B22D 45/00* (2013.01)

(58) Field of Classification Search

CPC ..... B22D 17/2053

USPC ..... 164/113, 303–318

See application file for complete search history.

(56) References Cited

U.S. PATENT DOCUMENTS

| | | | |
|---|---|---|---|
| 2,391,182 | A | 12/1945 | Misfeldt |
| 3,658,121 | A | 4/1972 | Douglas |
| 5,611,387 | A | 3/1997 | Chadwick |

(Continued)

FOREIGN PATENT DOCUMENTS

| | | | |
|---|---|---|---|
| EP | 2425913 A1 * | 3/2012 | ..... B22D 17/10 |
| GB | 475544 | 11/1937 | |

(Continued)

OTHER PUBLICATIONS

EPO machine translation of JP 58-184067 A (Year: 1983).*
PCT/CA2017/051237 ISR.
PCT/CA2017/051237 Written Opinion.

*Primary Examiner* — Kevin E Yoon
(74) *Attorney, Agent, or Firm* — Anglehart et al.

(57) ABSTRACT

A die casting insert for producing die casted metal parts from liquid metal. The die casting insert has an outer casing shaped to be fixed in the die block of the die casting apparatus. The die casting insert also has a stopper with a purge opening that is adapted to evacuate contaminants topping the liquid metal as pressure is applied to the liquid metal. The stopper, fitted to mate with the hollow inner cavity of the injection sleeve, is constructed to seal the hollow inner cavity of the injection sleeve except at the purge opening when in a first position; and to permit the flow of the liquid metal into at least one molding cavity when the stopper is in a second position. The die casting insert also has an activation mechanism configured to shift the stopper between the first position and the second position.

10 Claims, 13 Drawing Sheets

(51) Int. Cl.
*B22D 45/00* (2006.01)
*B22D 17/04* (2006.01)

(56) References Cited

U.S. PATENT DOCUMENTS

| | | | | |
|---|---|---|---|---|
| 5,730,201 | A | 3/1998 | Rollin et al. | |
| 5,853,041 | A | 12/1998 | Aoyama | |
| 5,954,116 | A * | 9/1999 | Jung | B22D 17/007 164/113 |
| 6,382,302 | B1 | 5/2002 | Imwinkelried | |
| 6,619,374 | B1 | 9/2003 | Morishita et al. | |
| 6,810,941 | B2 | 11/2004 | Tsuchiya et al. | |
| 6,904,951 | B2 | 6/2005 | Murayama et al. | |
| 6,997,231 | B1 | 2/2006 | Jung et al. | |
| 7,784,525 | B1 * | 8/2010 | Dai | B22D 17/08 164/120 |
| 2007/0012415 | A1 | 1/2007 | Tsuchiya et al. | |
| 2011/0108231 | A1 | 5/2011 | Zheng et al. | |
| 2015/0375296 | A1 | 12/2015 | Waniuk et al. | |

FOREIGN PATENT DOCUMENTS

| | | | |
|---|---|---|---|
| GB | 746712 | | 3/1956 |
| JP | 58148067 | A * | 9/1983 |
| JP | 3651045 | B2 | 3/2005 |
| JP | 2005059044 | A * | 3/2005 |

* cited by examiner

CONTAMINANT-PURGING COLD CHAMBER DIE CASTING APPARATUS AND METHOD

The present application claims priority from U.S. provisional application No. 62/440,043 filed on Dec. 29, 2016.

TECHNICAL FIELD

The present application relates to the field of cold chamber die casted molding and cold chamber die casting machines.

BACKGROUND

Die casting is the process of producing molded parts by forcing molten metal under high pressure into a molding cavity. The molding cavities are cavities created using, for example, two hardened steel dies called die blocks. The first die block may be called the ejector die block and can contain the ejector pins. The second die block may be called the cover die block and is usually secured to a stationary portion of the die casting machine. Both die blocks meet at a parting line. The metal alloy is poured into an injection sleeve, and from that injection sleeve, the metal alloy travels in response to a given pressure into molding cavities to take a desired shape.

In some conventional machines, once the metal alloy is pushed into the molding cavities, hardening and taking shape within the molding cavities, the molded parts may then slide off the cover die block and remain on the ejector die block. The ejector die block has ejector pins used to push the molded parts or the castings out of the ejector die block. The ejector pin plate found in the ejector die block is used to drive all of the ejector pins in the ejector die block at the same time and with the same force. The ejector pin plate may then retract the ejector pins in order to regain position for the next casting.

The die casting process normally involves first spraying the injection sleeve with a lubricant to prevent the metal alloy from sticking to the injection sleeve. A predetermined quantity of molten metal is ladled into the injection sleeve. The molten metal is then forced under high pressure from the injection sleeve into the molding cavities using a drive piston, the high pressure maintained until the castings solidify. The die blocks are then separated and the castings are ejected from the die blocks using the ejector pins. The scrap metal alloy, remaining in the runners (channels connected to the molding cavities), the gate, sprues and flash are then separated from the castings.

A problem in die casting is the porosity of the metal of the die casted parts resulting from the entrapment of air from above the liquid metal in the injection sleeve. This may be caused at least in part by the velocity of the hammer or the plunger for exerting pressure upon the metal alloy and the turbulent nature of the molten alloy. Another problem leading to a decrease in strength or durability of the die casted parts is the entrapment of contaminants, such as the lubricant used to coat the injection sleeve, within the metal alloy. The contaminants weaken the lattice structure of the metal as it solidifies and renders the die casted parts more brittle. To compensate for such structural weaknesses, it is typical to design parts to use more metal to maintain a target strength.

A solution to the entrapment of air in the die casted parts is the use of a die casting machine with a full injection sleeve and a counter plunger moving in the injection sleeve during a first stage of the injection. The counter plunger is placed in the movable die block. At the moment of die closing the counter plunger is pushed forward, and used with a plug closing a fill port at the opposite end of the injection sleeve. This use of the counter plunger with the plug allows for the complete filling of at least a portion of the injection sleeve with the metal alloy, leaving no room for air in the portion of the injection sleeve before the metal alloy is hammered into the molding cavities. However, this particular solution does not address the issues of the contaminants, such as the lubricant, mixed within the metal alloy, which may affect the structural integrity and durability of the die casted parts. However, this solution does not effectively separate the contaminant-heavy liquid metal from the rest of liquid metal.

SUMMARY

Applicant has discovered that expelling air and contaminants such as the lubricant from the injection sleeve prior to injecting the liquid metal into the molding cavities is advantageous in producing purer and more robust die casted parts. The Applicant has further discovered that a significant portion of the contaminants tend to rest above the liquid metal. As such, a purge opening or purge gate located at a or near a top of a stopper blocking metal flow into mold runners may allow for the evacuation of a significant portion of this top layer of contaminants by applying a first pressure to the contents of the injection sleeve, while minimizing the waste of liquid metal through this purge opening, prior to applying a second pressure for injecting the liquid metal into the molding cavities by a release of the stopper and allowing metal to flow into the runners.

A first broad aspect is a die casting insert for a die block of a die casting apparatus for producing die casted metal parts from liquid metal. The die casting apparatus has a fixed die block and an ejection die block, an injection sleeve joined to the fixed die block with a hollow inner cavity for receiving the liquid metal, an injection plunger (or piston) fitted to the hollow inner cavity for applying pressure to the liquid metal in the hollow inner cavity of the injection sleeve. The die casting insert has an outer casing shaped to be fixed in the die block of the die casting apparatus. The die casting insert also has a stopper with a purge opening that is adapted to evacuate contaminants topping the liquid metal as pressure is applied to the liquid metal. The stopper, fitted to mate with the hollow inner cavity of the injection sleeve, is constructed to seal the hollow inner cavity of the injection sleeve except at the purge opening when in a first position; and to permit the flow of the liquid metal into at least one molding cavity when the stopper is in a second position. The die casting insert also has an activation mechanism configured to shift the stopper between the first position and the second position.

In some embodiments, the die casting insert may include a fastening plate. The fastening plate and/or the outer casing may fit and secure the die casting insert to the ejection die block.

In some embodiments, the fastening plate may be structured to be fastened to a fastening cavity on a rear surface of the one of the ejection die block and the fixed die block, the rear surface of the one of the ejection die block and the fixed die block being opposite to a surface of the one of the ejection die block and the fixed die block adapted to form a parting line with a front surface of the other one of the ejection die block and the fixed die block.

In some embodiments, the die casting insert may include a directing contour surrounding the stopper adapted to direct the flow of the liquid metal to the runners when the stopper is in the second position.

In some embodiments, the purge opening may be shaped to connect with a purge chamber via a runner communicating with the purge chamber, wherein the contaminants are allowed to flow from the purge opening to the purge chamber through the runner.

In some embodiments, the activation mechanism may be an actuator configured to engage the shifting of the stopper between the first position and the second position.

In some embodiments, the actuator may be configured to respond to user input to engage the shifting of the stopper between the first position and the second position.

In some embodiments, the die casting insert may include a die casting insert controller configured to control and monitor the die casting insert.

In some embodiments, the die casting controller may include a controller module configured to regulate the functioning of the stopper via the actuator.

In some embodiments, the die casting controller may include an external trigger input configured to receive a signal requesting the triggering of the shifting of the stopper between the first position and the second position.

In some embodiments, the die casting controller may include non-volatile memory configured to store command information on controlling the shifting of the stopper between the first position and the second position, and/or monitoring information on the shifting of the stopper between the first position and the second position.

In some embodiments, the die casting insert controller may include a temperature sensor configured to monitor the temperature of the liquid metal in the molding cavities, the temperature of the liquid metal in the runners, and/or the temperature of the liquid metal in the injection sleeve.

In some embodiments, the die casting controller may transmit the temperature readings as temperature information to the controller module.

In some embodiments, the die casting insert controller may include a pressure sensor configured to measure the pressure exerted on the stopper by the liquid metal, and transmit the pressure readings as pressure information to the controller.

A second broad aspect is a die casting apparatus for producing die casted metal parts from liquid metal. The die casting apparatus has a fixed die block, and an ejection die block, fashioned to complement the shape of the fixed die block, the ejection die block and/or the fixed die block having ejection pins and at least one ejection plate. The die casting apparatus has at least one molding cavity hollowed in the ejection die block to receive the liquid metal via runners communicating with the molding cavities. The die casting apparatus also has an injection sleeve connected to the fixed die block comprising a hollow inner cavity shaped to receive the liquid metal, and a fill port dimensioned to allow the liquid metal to be poured into the hollow inner cavity. The die casting apparatus also has an injection plunger, fitted to the hollow inner cavity, structured to apply pressure to the liquid metal received by the hollow inner cavity of the injection sleeve. The die casting apparatus also includes a stopper fitted to mate with and seal the injection sleeve except for a purge opening structured to evacuate contaminants topping the liquid metal as pressure is applied to the liquid metal. The stopper is adapted to shift between two positions, the stopper sealing the hollow inner cavity of the injection sleeve except at the purge opening when in a first of the two positions, and the stopper permitting the flow of the liquid metal into the molding cavity or molding cavities when in a second of the two positions. The die casting apparatus has an activation mechanism configured to shift the stopper between the first position and the second position.

In some embodiments, the molding cavities may be distributed in the die blocks to allow the liquid metal to flow both upwards and downwards into the molding cavities from the injection sleeve via the runners.

In some embodiments, the activation mechanism may be an actuator configured to engage the shifting of the stopper between the first of the two positions and the second of the two positions.

In some embodiments, the die casting apparatus may include a purge chamber in the fixed die block and/or the ejection die block, adapted to receive the evacuated contaminants via a runner connected to the purge opening.

In some embodiments, the purge chamber may include a cavity for receiving the contaminants, wherein the cavity may be formed by corrugated walls.

In some embodiments, the spacing of the cavity may be sufficient to absorb at least a portion of the shock resulting from the pressure applied by the injection plunger when the pressure is applied to displace the liquid metal into the molding cavities.

In some embodiments, the die casting apparatus may include a temperature sensor configured to monitor the temperature of the liquid metal in the molding cavities, and/or the temperature of the liquid metal in the injection sleeve.

In some embodiments, the die casting apparatus may include a pressure sensor configured to measure the pressure exerted on the stopper by the liquid metal.

In some embodiments, the die casting apparatus may include a controller configured to control the actuator's engaging of the stopper in response to user input received by the controller.

In some embodiments, the injection plunger may be configured to apply at least two magnitudes of force onto the liquid metal, a first magnitude of force sufficient to push the contaminants through the purge opening, and a second magnitude of force sufficient to cause the liquid metal to flow into the molding cavities via the runners.

In some embodiments, the actuator may engage the shifting of the stopper between the first of the two positions and the second of the two positions when sufficient pressure is exerted on the stopper by the liquid metal.

A third broad aspect is a method for producing die casted metal parts involving evacuating at least a portion of contaminants topping liquid metal in an injection sleeve from above through a purge opening and into a purge chamber via a runner as pressure is applied to the liquid metal prior to injecting the liquid metal into one or more molding cavities.

In some embodiments, the method may include lubricating the hollow inner cavity of the injection sleeve with a lubricant prior to filling the hollow sleeve with the liquid metal, wherein evacuating includes evacuating at least a portion of the lubricant as part of the contaminants.

In some embodiments, the method may include applying an initial pressure to the liquid metal with the injection plunger prior to the evacuation of the contaminants, wherein the initial pressure is sufficient to cause the contaminants to be evacuated from above through the purge opening.

In some embodiments, the method may include delivering the contaminants to a purge chamber hollowed in at least one of the die blocks via a runner communicating with the purge opening.

In some embodiments, the evacuating of the contaminants may occur through a purge opening located on a top of the stopper.

In some embodiments, the method may include moving the stopper from a first position to a second position to allow flow of the liquid metal into the one or more molding cavities when a second pressure is applied to the liquid metal with the injection plunger, wherein the stopper seals the hollow inner cavity in the first position except for at the purge opening, and the stopper allows the liquid metal to flow into the one or more molding cavities via one or more runners communicating with the one or more molding cavities in the second position.

In some embodiments, the method may include actuating the stopper to move from the first position to the second position when the second pressure is applied to the liquid metal.

In some embodiments, the method may include injecting the liquid metal into the one or more molding cavities via the one or more runners communicating with the one or more molding cavities.

In some embodiments, the method may include separating the ejection die block from the fixed die block.

In some embodiments, the method may include recycling leftover liquid metal accumulated in the one or more runners.

In some embodiments, the method may include singularizing the die casted metal parts.

BRIEF DESCRIPTION OF THE DRAWINGS

The invention will be better understood by way of the following detailed description of embodiments of the invention with reference to the appended drawings, in which.

DETAILED DESCRIPTION

When traditional die casting is performed, there is a risk that contaminants get trapped within or mixed with the liquid metal and destabilize the structure of the solidified die casted part as these contaminants are not expelled from the liquid metal mixture before molding. Namely, such contaminants may include air, oxidized metal and lubricants used during the die casting process for coating the insides of an injection sleeve. The injection sleeve receives the liquid metal, and a controlled quantity of the lubricant is applied to the inner walls of the injection sleeve to prevent the liquid metal from sticking to the inner walls of the injection sleeve. However, the lubricant also remains in the injection sleeve. Excess lubricant may rise and rest as a film on top of the liquid metal. The lubricant may be mixed with other impurities, forming a layer of contaminants. The exemplary die casting apparatus taught herein is structured to allow for the expulsion of these contaminants, leaving a purer form of liquid metal for injection into the molding cavities. The metal molded into the desired casted parts is therefore purer than if these contaminants were not previously expelled, allowing for a sturdier, resistant die casted part. Furthermore, due to the increase resistance and durability of the formed die casted part, this increase allows for the molding of thinner die casted parts, now that the die casted part benefits from an increased tensile strength.

Figure 1:
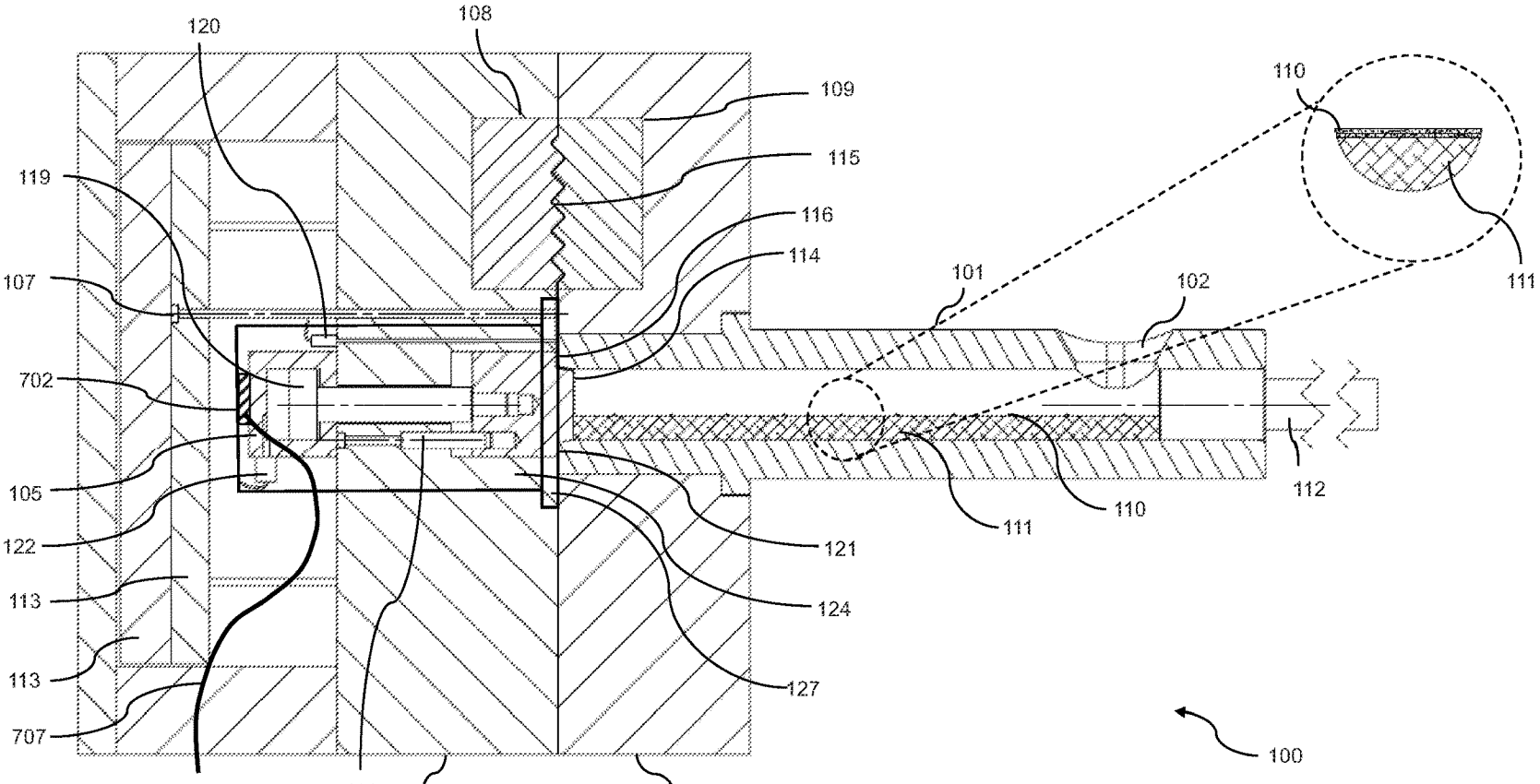
FIG. 1 is a side cross-sectional view of an exemplary die casting apparatus, with a die casting insert adapted to be inserted into a die block of the exemplary die casting apparatus, showing a front cross-sectional close-up view of the liquid metal and the film of contaminants resting on the top of the liquid metal.

Reference is now made to FIG. 1, illustrating an exemplary cold chamber die casting apparatus 100. The die casting apparatus 100 is constructed to receive liquid metal and allow the liquid metal to flow as a result of applied pressure into molding cavities for producing die casted parts from the molds when cooled. The liquid metal may be, for example, a metal alloy, such as a metal alloy composed of aluminum, magnesium, copper, lead, or tin. In some examples, a ferrous metal alloy may be used.

The die casting apparatus 100 has a fixed die block 103 and an ejector die block 104 (also defined herein as a mobile die block).

The fixed die block has an injection sleeve 101. The injection sleeve 101 has a fill port 102 shaped to allow the liquid metal to be poured into an inner cavity of the injection sleeve 101. In such a way, the injection sleeve 101 may be shaped as a hollow cylinder with an opening at either end for receiving, at one end, an injection plunger 112 (also defined herein as injection piston), and at the other end, for instance, a stopper 114 that may function as a plug, as will be further explained herein. The fixed die block 103 may also have a portion 109 of a purge chamber 115 for receiving contaminants 110 that rests on the top of the liquid metal 111. In some examples, the hollow inner cavity of the injection sleeve 101 may be lined with a ceramic-based material. In some examples, the injection sleeve 101 may be composed of titanium or of a special purpose tool steel.

Figure 2:
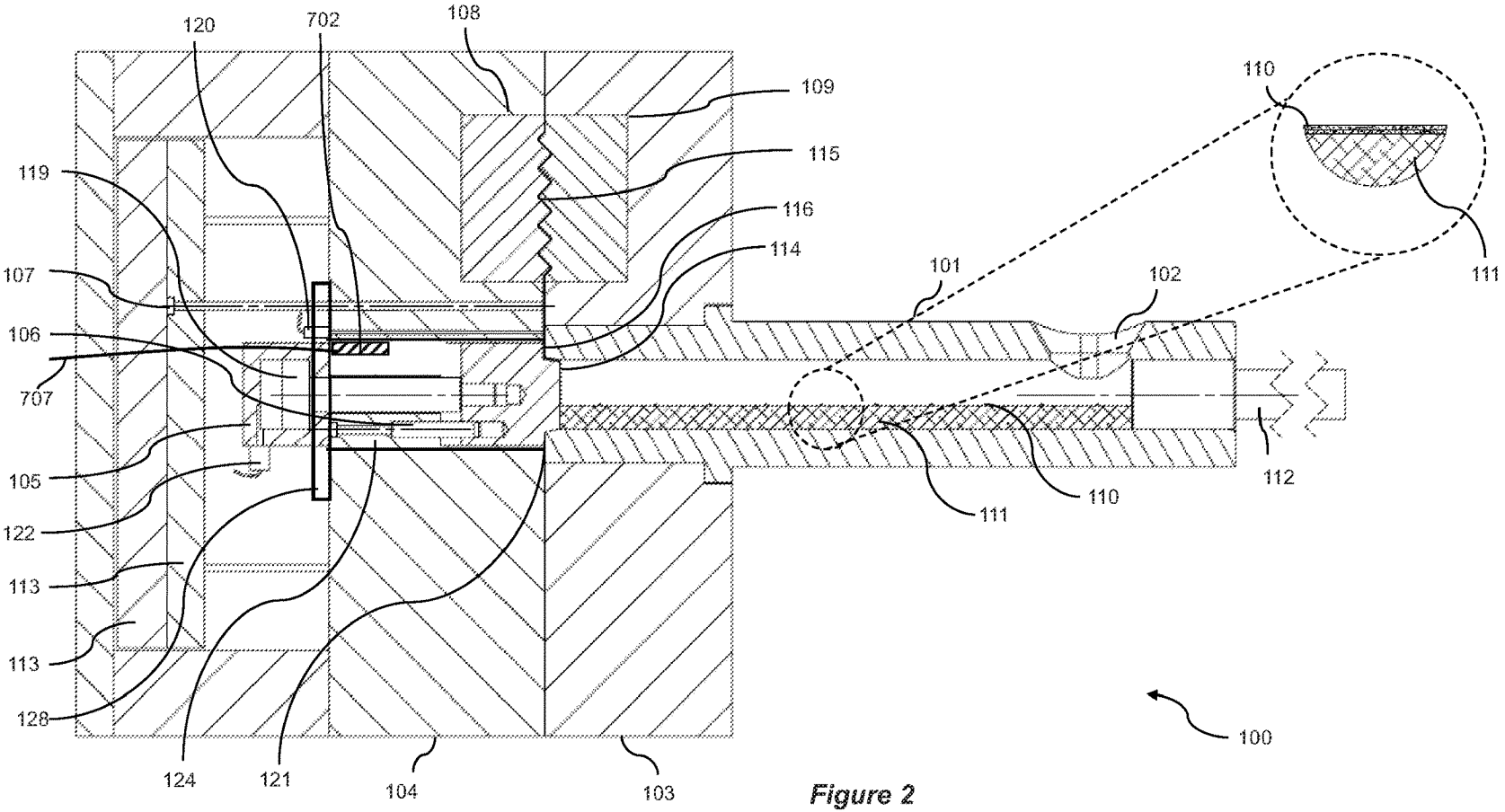
FIG. 2 is a side cross-sectional view of an exemplary die casting apparatus, with a die casting insert adapted to be inserted into a die block of the exemplary die casting apparatus, showing a front cross-sectional close-up view of the liquid metal and the film of contaminants resting on the top of the liquid metal.
Figure 3:
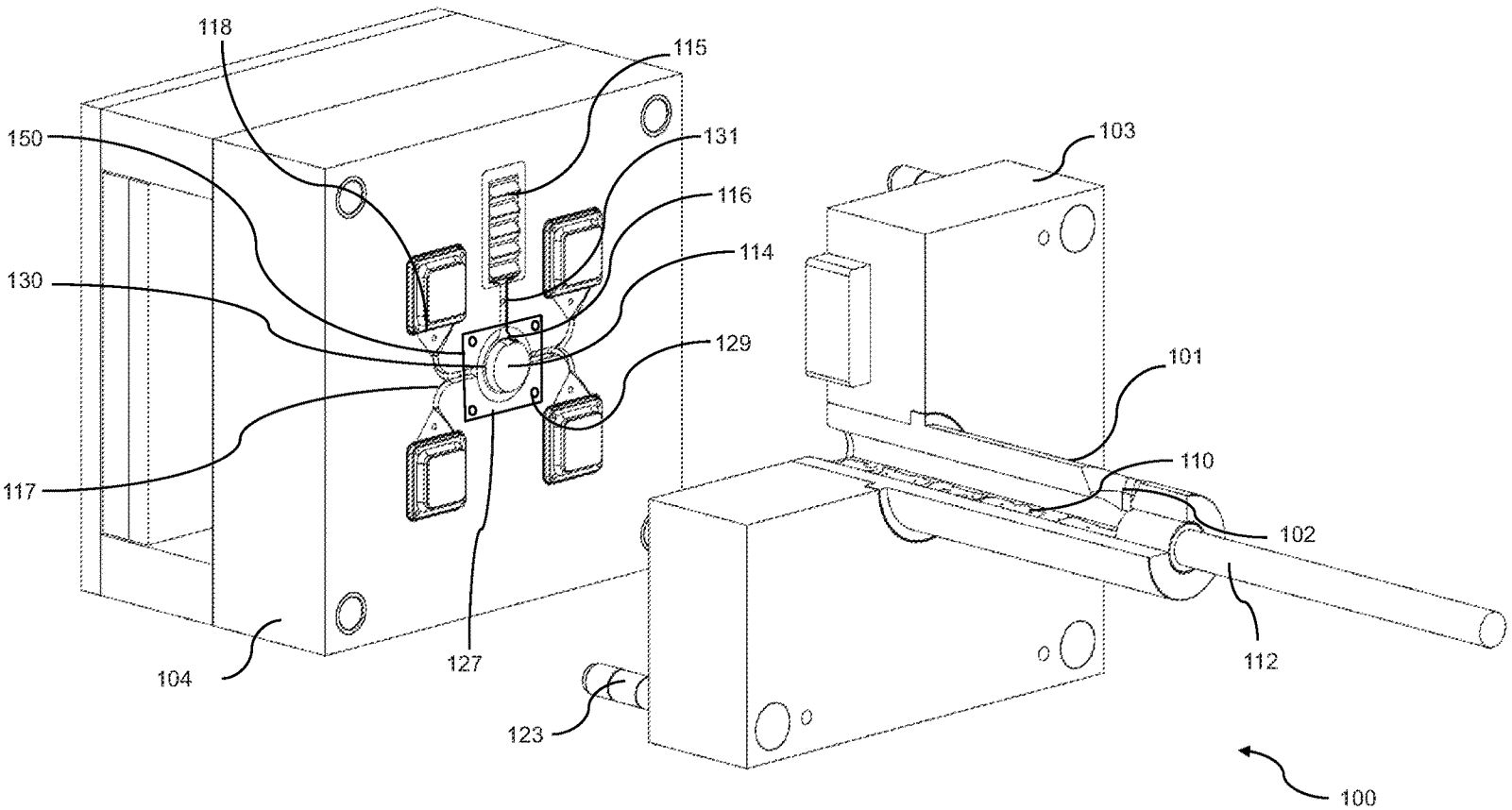
FIG. 3 is a perspective view of an exemplary die casting apparatus where an upper corner of the fixed die block is not shown wherein the fixed die block is separated from the ejector die block, the injection sleeve of the fixed die block being filled with liquid metal and a film of contaminants being located atop of the liquid metal.

The purge chamber 115, as illustrated in FIGS. 1, 2 and 3, can have a defined volume larger than the expected volume of metal and contaminants to be purged. Preferably, it defines a thin part that will solidify quickly after the purge volume enters the purge chamber 115. The purge chamber 115, along with the molding cavities 118, can be connected to a source of vacuum prior to metal injection, so that trapped air does not interfere with injection. In some embodiments, either or both of the die blocks 103 or 104 may have vents for allowing the trapped air to escape therefrom (not shown).

While stopper 114 adds some complexity to the ejection die block 104, it will be seen in FIG. 3 that the runners 117 are placed on opposed sides with respect to the injection sleeve 101 with part molding cavities 118 arranged above and below the injection sleeve 101. In a conventional mold, the contaminants and the cold front of the liquid metal are flushed out through the molding cavities into overflows. However, the flushing of the contaminants and the cold front of the liquid metal in this manner is inefficient and wasteful as the contaminants and the cold front of the liquid metal pass through the entire length of the runners, and through the molding cavities, before finally being expelled, the path leading to expulsion being often convoluted and offering resistance. Moreover, in this non-optimal flushing, the pushing of the contaminants and the cold front of the liquid metal is performed by the liquid metal, resulting in waste of the liquid metal 111. In contrast, in the exemplary die casting apparatus 100 and as shown in FIG. 3, the liquid metal 111 flowing into the runners 117 has had the contaminants 110 removed, and therefore, the runners 117 can extend above and below the injection sleeve 101. This reduces the branching and the path length from the injection sleeve 101 to the molding cavities 118.

It will be appreciated that the evacuation of the contaminants 110 prior to the liquid metal 111 entering the runners 117 allows for shorter runners 117, and subsequently, a reduction of wasted metal that would solidify in the runners 117, because there is no need to have a purge chamber connected to the runners 117, or branching from the runners 117.

It will also be appreciated that even though the exemplary die casting apparatus 100 is shown to have two runners 117, each forking into two sub-runners leading to four molding cavities 118, the number of runners 117 may vary without departing from the present teachings.

The ejection die block 104 has ejection pins 107, and ejection plates 113. While ejection pins 107 can also or alternatively be provided on the fixed die block 103, the runners 117 and sprue gates are, in the embodiment shown, provided in ejection die block 104 such that the die cast part and residual metal will remain with the ejection die block 104 as it is separated from fixed die block 103 at the end of a die cast cycle. A plug of metal will also normally remain in the injection sleeve 101 that will be pulled out of the injection sleeve 101 when ejection die block 104 separates from the fixed die block 103 at the end of the die cast cycle. The ejection die block 104 has a stopper 114 with an activation mechanism 119. The stopper 114 has also a purge opening 116 in its upper part for allowing the contaminants 110 to flow through when a certain pressure is applied to the liquid metal 111. In some embodiments, the ejection die block 104 may also have a seal-off surface 121. In some embodiments, the ejection die block 104 may also have a guide pin 106 structured to maintain the alignment of the stopper 114. Metal from the cavity, introduced when stopper 114 is retracted, may be molded solid with the runner 117 and may be ejected as one piece with the runner 117. Moreover, the stopper 114 may be moved to the forward position synchronized with the motion of the ejection plates 113 to act as an ejection assist. The ejection die block 104 may also have a temperature sensor 120 and a pressure sensor 122. The ejection die block 104 may also have a portion 108 of the purge chamber 115. The ejection die block has molding cavities 118.

The Components of the Fixed Die Block:

The injection sleeve 101 is a long hollow cylinder for receiving liquid metal. The injection sleeve 101 may be of different shapes and lengths depending upon the properties of the die casting apparatus and the die casted parts to be produced. The injection sleeve 101 may be removable from the ejection die block 104. The inner cavity of the injection sleeve 101 may be shaped in such dimensions as to receive a quantity of liquid metal 111. In some examples, the liquid metal 111 may partially fill the inner cavity of the injection sleeve 101, where in other examples, the inner cavity of the injection sleeve 101 may be almost entirely filled, leaving little room for air. The inner wall of the injection sleeve 101, forming its inner cavity, may be lined with a lubricant before the pouring of the liquid metal 111 for preventing the liquid metal 111 from sticking to the inner walls of the injection sleeve 101. As explained herein, because the purge opening 116 is fashioned to allow a significant portion of contaminants 110, these contaminants 110 including the lubricant, to be expelled therefrom when pressure is applied to the liquid metal 111, the amount of lubricant added before pouring in the liquid metal 111 does not have to be as carefully measured as if there was no way to remove excess lubricant and prevent significant inclusions within the metal part. Furthermore, when pouring liquid metal 111 into the hollow inner cavity of the injection sleeve 101, the first metal to be ladled may contain more oxides and may also further react as it is first to come into contact with the lubricant. This first metal may therefore be of a lesser quality, the die casted parts shaped from the first metal more prone to defects. As a result, controlling the pressure applied by the injection plunger 112 over time to guide the movement of the first metal in the hollow inner cavity of the injection sleeve 101 may be useful for evacuating the first metal through the purge opening 116 with the rest of the contaminants.

The injection piston or injection plunger 112 is shaped to fit into and seal off the opening of the injection sleeve 101 opposite to the end of the injection sleeve 101 joined to the fixed die block 103. The injection plunger 112 is structured to apply a desired pressure to the contents of the inner cavity of the injection sleeve 101 once liquid metal 111 has entered the inner cavity of the injection sleeve 101 via, for example, the fill port 102. The contents of the inner cavity of the injection sleeve 101 may be, for example, the liquid metal 111, the contaminants 110, including the lubricant, and air. The injection plunger 112 (and its drive mechanism as is known in the art) may be further configured to apply at least two different magnitudes of force (resulting in pressure applied on the liquid metal 111) to the contents of the injection sleeve 101, the force applied onto the contents of the injection sleeve 101 by pushing onto the contents as the injection plunger 112 slides further into the inner cavity of the injection sleeve 101, reducing the volume occupied by the contents in the injection sleeve 101. For instance, the injection plunger 112 may be configured to apply a first, lesser force, to the content of the injection sleeve 101. This first force is sufficient to reduce the volume in the injection sleeve 101 causing the contaminants 110 to be pushed next to the top (or to the top) of the inner cavity of the injection sleeve 101, and this first force sufficient to expel these contaminants 110, now resting at or near the same level as the purge opening 116, from the purge opening 116, the force squeezing the contaminants 110 through the purge opening 116. Once the contaminants 110 have been eliminated, the injection plunger 112 is further configured to apply a second force, greater than the first force, to the liquid metal 111. This second force may be applied abruptly through a hammering action, the second force sufficient to push the stopper 114 back, allowing the liquid metal 111 to flow through runners 117 into molding cavities 118. The stopper 114 can have an adjustable force biasing mechanism to hold the stopper 114 in place.

In some embodiments, the stopper 114 may function by moving forward against the injection sleeve 101, and closing the seal off surface 121 created by their respective mating surfaces. In some examples, the forward position of the stopper 114 blocks the runners 117 and its back position allows the metal to flow from the hollow inner cavity of the injection sleeve 101, free to flow into the molding cavities 118 via the runners 117.

Figure 8:
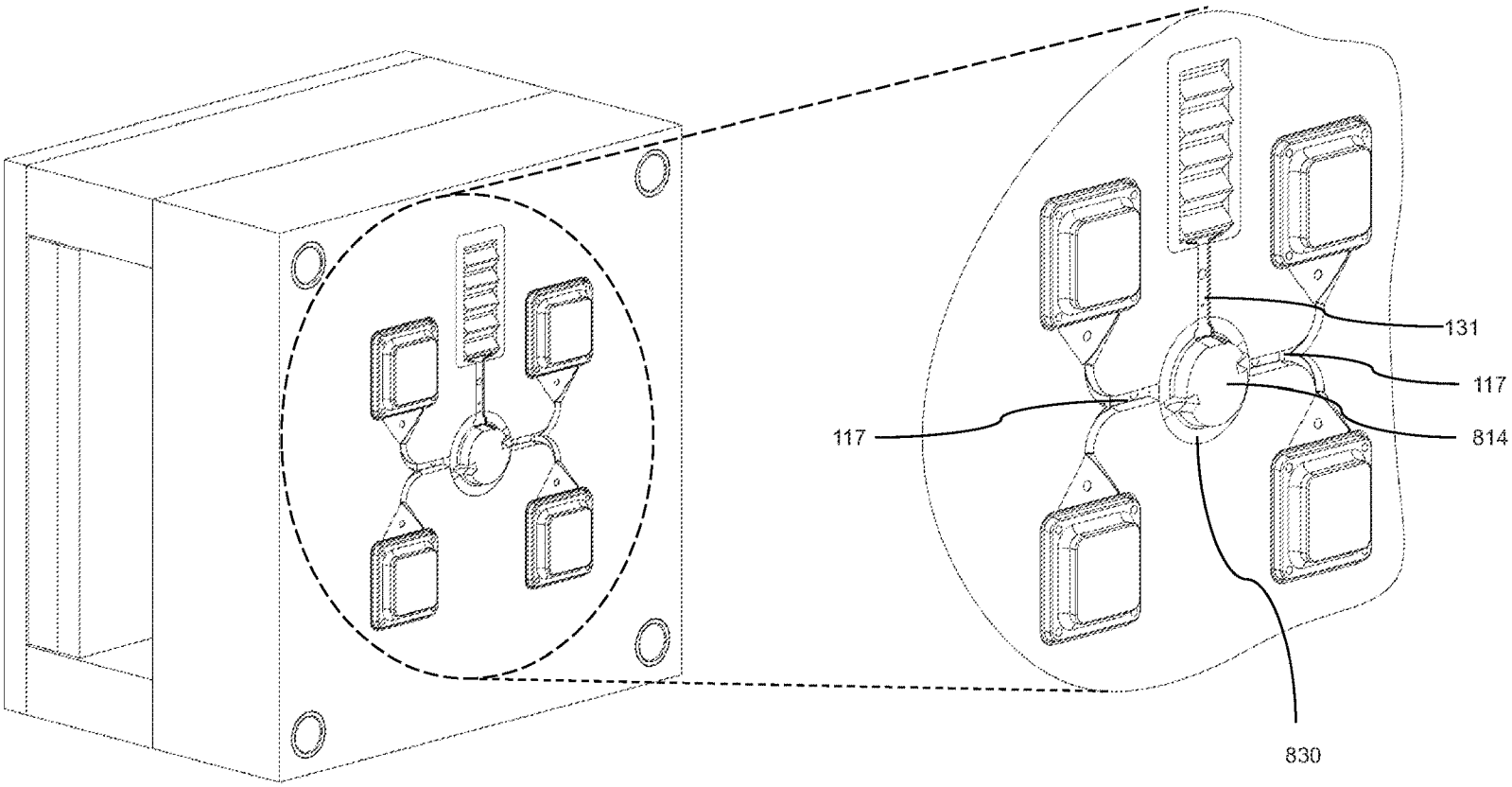
FIG. 8 is a perspective view of an exemplary ejection die block of an exemplary die casting apparatus with a rotary stopper, and a close up view of namely an exemplary rotary stopper, an exemplary directing contour, exemplary runners, an exemplary purge chamber and exemplary molding cavities.

In some alternative embodiments, as shown in FIG. 8, the stopper may be a rotary stopper 814, where the rotary stopper 814 may rotate between at least two positions to control the evacuation of contaminants 110, and to allow or prevent the flow of liquid metal 111 into the molding cavities 118 depending upon its rotary position. The rotary stopper 814 may have notches or gates, tailored to match and create a channel respectively with the runners 117 of the ejection die block 104, or the runner 131 leading to the purge chamber 115. In a first rotary position, the purge notch of the rotary stopper 814 aligns with the runner 131, but the notches tailored to match the runners 117 do not align with the runners 117, allowing for the flow of contaminants 110 through the purge opening 116 leading to runner 131, but blocking the flow of liquid metal 111 into the runners 117. At a second rotary position, the notches of the stopper 114, tailored to align with the runners 117, align with the runners 117, creating a path from the injection sleeve 101 to the runners 117, but, as the purge notch is no longer aligned with the runner 131, the path to the runner 131 becomes blocked. Therefore, in the second position, the liquid metal 111 may flow from the injection sleeve 101 into the molding cavities 118 via the runner 117, but not escape via the purge opening 116 connected to the runner 131. In these alternative embodiments, the rotary stopper 814 may be maintained in the forward position, closing the seal off surface 121 created by the mating surfaces between the injection sleeve 101 and the rotary stopper 814, except for the purge opening when the rotary stopper 814 is the first rotary position, and the runner channels leading to the molding cavities 118 when the rotary stopper 814 is in the second rotary position. The shifting of the rotary stopper 814 between its first rotary position and its second rotary position may be controlled, for example, by an actuating mechanism (e.g. electrical, mechanical) as is known in the art.

A directing contour 830 may also surround the rotary stopper 814. The directing contour 830 may have channels adapted to match with the runners 117 and 131. The directing contour 830 may rotate with the rotary stopper 814, where the alignment of the channels of the directing contour 830 depend upon the rotary position of the rotary stopper 814. In some other embodiments, the directing contour 830 may be fixed, the channels of the directing contour 830 aligned with the runners 117 and 131. In the examples where the directing contour 830 is fixed, the notches of the rotary stopper 814 align with the channels of the directing contour 830 that match up with the runner 131 in one rotary position, and align with the channels of the directing contour 830 that match up with runners 171 in a second rotary position.

In some embodiments, such as when die casting small parts, the first and second force may not be exerted by an injection plunger 112, applying a pushing force, but instead using a vacuum force, where the contaminants and the liquid metal are sucked or pulled through respectively the purge opening 116 and the runners 117 into the molding cavities 118. In some examples, the purge chamber 115 may be connected to a vacuum device, the vacuum device being one as is known in the art. In some examples, the die casting apparatus 100 may have overflows, or a vacuum force (not shown) connected to the molding cavities 118, where the overflows or vacuum force may be of a reduced size and/or force when compared to die casting machines as are known in the art, because the overflows or vacuum force may be used to only evacuate any residual air that may be trapped in the molding cavities 118, as a substantial portion of the contaminants 110 have already been evacuated via the purge opening 116.

In some embodiments, the stopper 114 may be pulled back to a second position, at the required moment, using an activation mechanism 119 (e.g. an actuator, an engaging mechanism), allowing the liquid metal 111 to flow into the runner 118 in response to a control signal. In this example, when the injection plunger 112 is used to apply a certain pushing force, the second force exerted by the injection plunger 112 does not have to be sufficient to push back the stopper 114, but simply to drive the liquid metal 111 into the runners 117 as the stopper has already moved to the second position as a result of the activation mechanism 119.

The fill port 102 of the injection sleeve 101 is a hole with a sufficient opening (e.g. diameter) to allow for the pouring of liquid metal 111 (and/or lubricant prior to the adding of the liquid metal 111) into the inner cavity of the injection sleeve 101.

The Components of the Ejection Die Block:

The ejector pins 107 may be placed throughout the ejection die block 104. The ejector pins 107 are of a sufficient number, or sufficient strength, and located in such a way, for pushing the castings of die casted parts from the molding cavities 118. The ejector pins 107 are activated via the ejector plate 113 (or ejector plates 113), which accurately drives all of the ejector pins 107 at the same time and with the same force to expel the castings from the molding cavities 118 without damaging the castings.

The ejector pins 107 may be located in some examples so they make the full width of the ejection die block 104 and extend outward from the ejection die block 104, away from the parting line, before resting on the ejector plate 113. Some of the tips of ejector pins 107, opposite to the tip resting on the ejector plate 113, may be located next to, or joined to, the molding cavities 118 as shown by the small circular points in FIG. 3 in the portion of the molding cavity 118 immediately following the runners 117. Other tips of the ejector pins may be located at the runners 117, or the runner leading to the purge chamber 115. It will be understood that the location and number of ejector pins 107 may vary without departing from the present teachings as long as the number and location of the ejector pins 107 are such as to allow for the accurate expulsion of the castings from the molding cavities 118 without damaging the castings.

The ejection die block 104 also has a stopper 114. The stopper 114 may be shaped to fit into and seal off the inner cavity of the injection sleeve 101 when the stopper 114 is in a first position, the stopper 114 and the injection sleeve 101 creating a seal off surface 121 when the stopper 114 is in the first position. However, in some embodiments, the seal of the injection sleeve 101 by the stopper 114 may be partially breached at the time the stopper 114 is positioned in its first position, where a purge opening 116 (e.g. a purge gate) is located at the top of the stopper 114. The purge opening 116 may be a groove running across the edge of the stopper 114, the groove perpendicular to the sealing surface of the stopper 114. The shape of the purge opening 116 on the stopper 114 may vary, as long as it is located on or near the top of the stopper 114 so as to evacuate the contaminants 110 while minimizing the loss of liquid metal 111 through the purge opening 116.

In some examples, the stopper 114 may be a button. In some embodiments, the stopper 114 may be of a circular, disc-like shape. However, in other examples, the stopper 114 may be of other shapes, such a square, rectangle or polygonal shape and may match the shape of the perimeter of the cross-section of the injection sleeve 101, without departing from the present teachings.

The stopper 114 may be configured to shift from a first position to a second position. In the first position, the stopper 114, alone or in combination with directing contour 130, prevents the flow of liquid metal 111 into the molding cavities 118 via the runners 117. The contour 130 may have an angled edge to assist with sealing the hollow inner cavity injection sleeve 101. In the second position, the stopper 114 moves back, away from the injection sleeve 101, the displacement from the first to second position sufficient to allow at least partial access to the runners 117, or for the liquid metal to flow out from the injection sleeve 101. The liquid metal 111, its path no longer hindered by the stopper 114, may flow into the runners 117 and enter into the molding cavities 118. The shift by the stopper 114 from the first to the second position may be actionable, such as via an actuator 119 as further explained herein.

In some embodiments, the die casting apparatus has a directing contour 130 that may surround the stopper 114, assisting with the directing of the liquid metal 111, when the liquid metal 111 is flowing out of the injection sleeve 101, into the runners 117. In some examples (not shown), the directing contour 130 may also comprise grooves that may match the runners 117, so the liquid metal 111 flows into the grooves of the directing contour 130 and then into the runners 117. The directing contour 130 may be of an annular shape, or of a similar shape as the stopper 114, surrounding the stopper 114. The directing contour 130 may also be of a different shape to that of the stopper 114 and not be annular (e.g: as a parallelogram, etc.). The directing contour 130 may have a tapered seal off surface angle, with the injection sleeve 101. In some examples, the seal off angle may be between 5 degrees and 15 degrees to optimize removal of solidified liquid metal 111 following the die casting process.

The ejection die block 104 may have an activating mechanism 119 (i.e. also defined herein as an actuator 119) for shifting or engaging the stopper 114 between its first and second positions. In some examples, the activating mechanism 119 may be manual, electrical or mechanical. For instance, the activating mechanism 119 may be a spring mechanism with a given coefficient of stiffness, obeying Hooke's Law. In other embodiments, the spring mechanism may be a non-linear sprint or a pneumatic spring. In this example, the stopper 114 may shift from the first position to the second position when sufficient force is exerted by the liquid metal onto the stopper 114, sufficient to cause a compression of the spring of the activation mechanism 119 equivalent to the difference in displacement between the first position and second position of the stopper 114. In other examples, the actuator 119 is manually tripper, such as engaging the shifting of the stopper 114 in response to user input. In other examples, the actuator 119 may be triggered by a release mechanism, responding to, for instance, the application of a sufficient magnitude of force applied by the liquid metal 111 (or by the injection plunger 112). The actuator 119 may also respond to the pressure exerted by the liquid metal 111 as observed by a pressure sensor 122, the pressure sensor 122 further described herein. The actuator 119 may also have an external housing 105 for receiving, enclosing and protecting the actuator 119. The external housing 105 may enclose a portion or the entirety of the actuator 119. The actuator 119 may move the stopper 114 back from the second position to the first position when pressure is no longer applied by the liquid metal 111, such as when the liquid metal 111 has flowed into the runners 117 and the molding cavities 118.

The purge opening 116 is an opening for letting the contaminants 110, located on the top of the liquid metal 111, be expelled therefrom when a pressure is applied on the liquid metal 111 causing the surface contaminants to rise to the top of the inner cavity of the injection sleeve 101 (e.g. the pressure reducing the volume taken by the liquid alloy 111 and the contaminants 110 as excess air is pushed through the purge opening 116 as pressure is applied, the contaminants 110 rising upwardly in the inner cavity of the injection sleeve 101 as a result) and in some examples, get squeezed or pushed through the purge opening 116. The purge opening 116 is positioned on the die casting apparatus 100 in such a way it may receive the surface contaminants 110. For instance, when the purge opening 116 is located on the stopper 114, the purge opening 116 is placed at the top of the stopper 114, as the contaminants 110 are located on the upper surface of the liquid metal 110 and may rise to the top of the inner cavity of the inner sleeve 101 and out of the purge opening 116 when sufficient pressure is applied and the volume taken by the contents of the purge opening 116 is sufficiently reduced causing the contaminants 110 to rise. Similarly, the purge opening 116 may also be used to expel excess air trapped or contained in the inner cavity of the injection sleeve 101 as the volume of the inner cavity is reduced as the injection plunger 112 moves further into the inner cavity of the injection sleeve 101.

Figure 7:
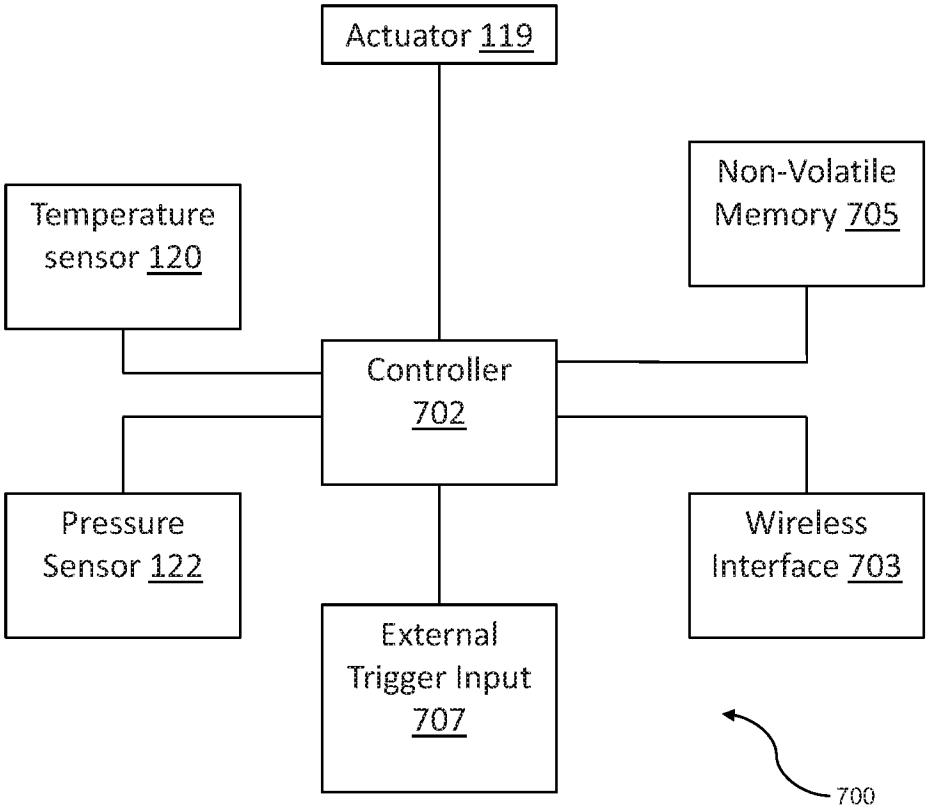
FIG. 7 is a block diagram of an exemplary die casting controller configured to control the die casting insert.

The pressure sensor 122 is used to detect and/or measure the pressure applied by the liquid metal 111, for instance, on the stopper 114. The pressure sensor 122 may be connected directly or indirectly to the actuator 119, such as shown in FIG. 7, whereupon the application of a pressure with a given magnitude by the liquid metal 111, the pressure read by the pressure sensor 122, the actuator 119 moves the stopper 114 from a first position to the second position.

The ejection die block 104 may also have a temperature sensor 120. The temperature sensor 120 may be that as known in the art and may read the temperature of, for instance, the liquid metal 111 in the injection sleeve 101, the temperature of the substance moving into the purge chamber 115 via the runner connected to the purge opening 116, the injection sleeve 101 itself, or the temperature of the metal in the molding cavities 118. The temperature readings provided by the temperature sensor 120 may indicate when the liquid metal 111 located in the molding cavities 118 has or is at the point of reaching solidification.

The die blocks 103 and 104 also have molding cavities 118 shaped to receive the liquid metal 111. The molding cavities 118 are shaped as a function of the parts which are to be die cast. In some examples, the cavity side of the die casted part may be on the fixed die block 103 and the core side of the die casted part may be found on the ejection die block 104 following die casting. In some embodiments, there may be ejector pins and ejector plates on both the die blocks 103 and 104, in order to eject the castings from the molded cavities when the castings may be joined to either die blocks 103 or 104 following the separation of the fixed die block 103 and the ejection die block 104. Some examples may have ejection pins and ejection plates on the fixed die block 103. In some examples, there may be one molding cavity 118. In other embodiments, and more typically, there may be more than one molding cavity 118. The molding cavities 118 may be arranged on the die blocks 103 and 104 in such a way that they are located both upward and downward with respect to the meeting point where the liquid metal 111 flows from the injection sleeve 101 into the runners 117. In other examples, the molding cavities 118 may be either only upwardly located, downwardly located or located at a same height as the point where the liquid metal 111 flows from the injection sleeve 101 into the runners 117.

The molding cavities 118 may be interchangeable and insertable, in order to provide the option of altering between different molding cavities 118 for yielding different die casted parts.

Figure 4:
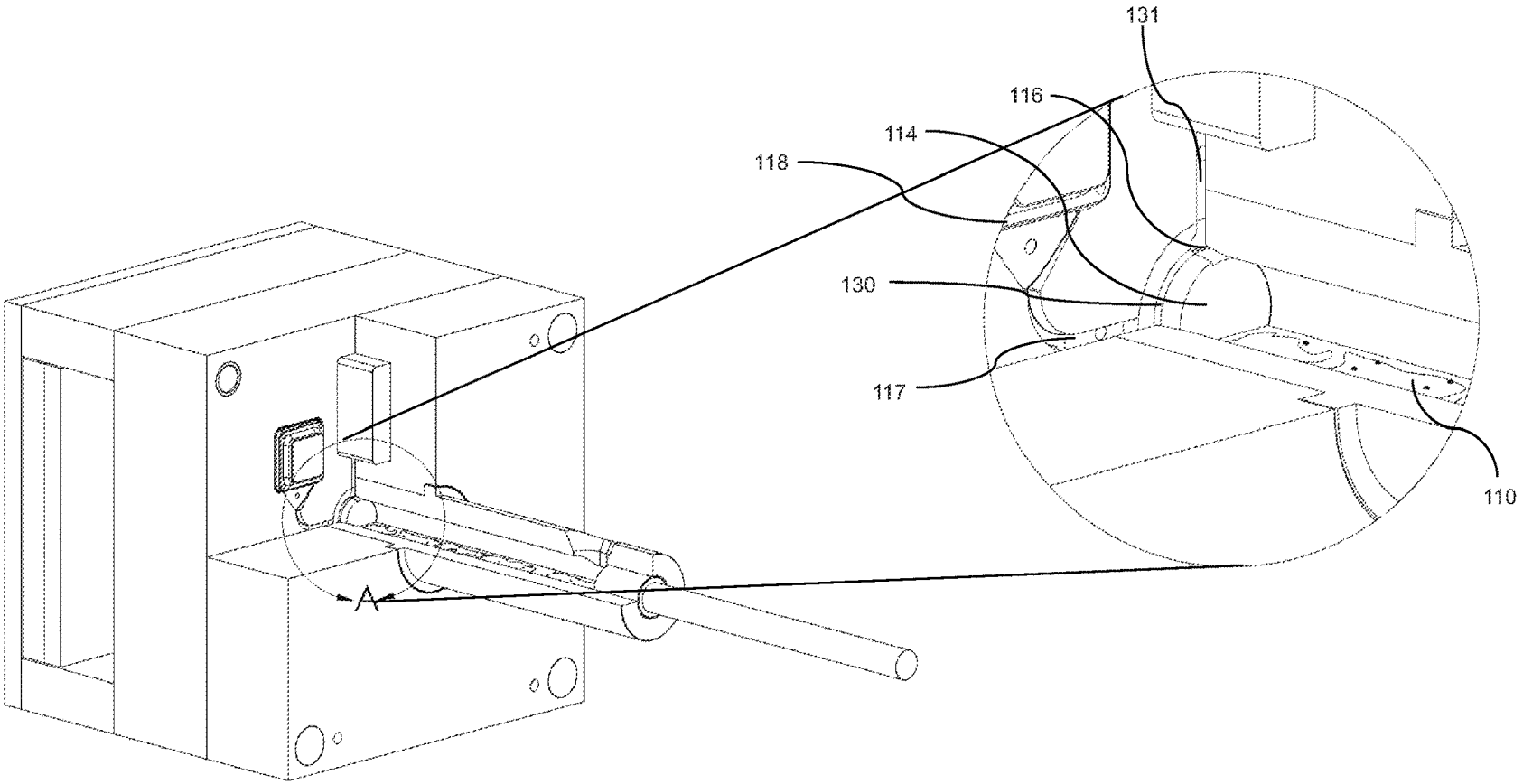
FIG. 4 is a perspective view of an exemplary die casting apparatus where an upper corner of the fixed die block is not shown for illustrating the position of the stopper and the ejector die block when the fixed die block is joined to the ejector die block.
Figure 9A:
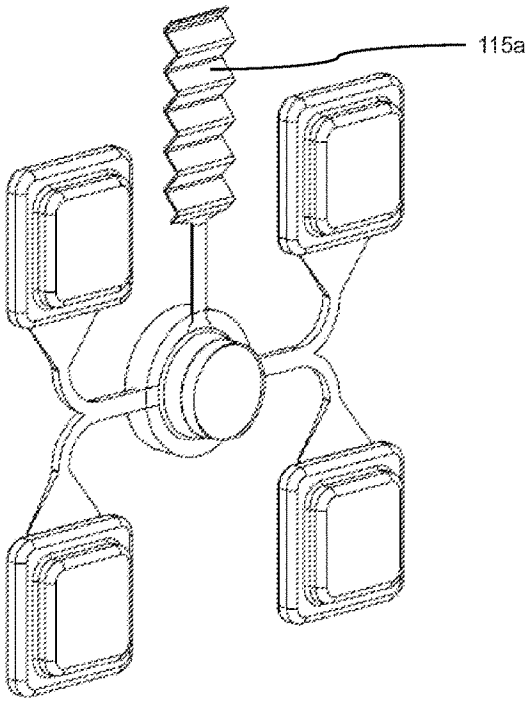
FIG. 9A is a perspective view of namely an exemplary stopper, exemplary runners, an exemplary purge chamber and exemplary molding cavities.
Figure 9B:
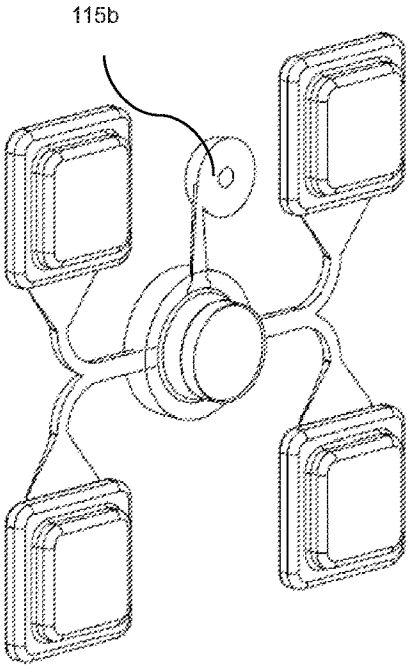
FIG. 9B is a perspective view of namely an exemplary stopper, exemplary runners, an exemplary purge chamber and exemplary molding cavities.
Figure 9C:
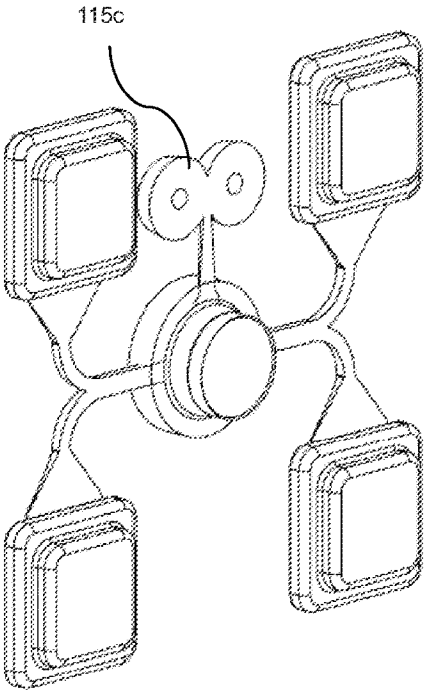
FIG. 9C is a perspective view of namely an exemplary stopper, exemplary runners, an exemplary purge chamber and exemplary molding cavities.

Components Found on Either One or Both of the Ejection Die Block or Fixed Die Block:

Reference is also made now to FIGS. 3 and 4. The die casting apparatus 100 may have a purge chamber 115 structured to receive the contaminants 110 through a runner connecting with the purge opening 116. The purge chamber 115 is shaped to receive and contain the contaminants 110. In some embodiments, the purge chamber 115 has a corrugated or undulated empty cavity (i.e. a wafer shape) resulting from the shape of the walls surrounding the empty cavity. For example, exemplary purge chambers 115*a*, 115*b* and 115*c* may be shaped as a wafer, a disc, or two joined discs, as shown respectively in FIGS. 9A, 9B and 9C. The purge chamber may be adapted to leave a void or space therein after the entering of the contaminants 111, this void existing prior to the hammering by the injection plunger 112 and acting to absorb a shock from the hammering by the injection plunger 112. In other embodiments, the shape of the empty cavity of the purge chamber 115 as well as its walls may vary (e.g. a swirl pattern) without departing from the present teachings. The empty cavity of the purge chamber 115 is connected to the purge opening's runner so as to receive the contaminants 110.

In some embodiments, the empty cavity of the purge chamber 115 is located between both die blocks 103 and 104, where half of the purge chamber 115 is located on each of the die blocks 103 and 104. In these embodiments, the empty cavity of the purge chamber 115 may be formed at the parting line of the die casting apparatus 100, where both die blocks 103 and 104 meet, and more specifically, within the purge chamber 115 at that parting line. The purge chamber 115 may be an insertable component into the die blocks 103 and 104. In other embodiments, the purge chamber 115 may be fixed to the die blocks 103 and 104 (e.g. portions 108 and 109 of the purge chamber 115).

In other embodiments, the entire purge chamber 115 may be found in one of the two die blocks 103 and 104, the contaminants 110 flowing into the purge chamber 115.

In some embodiments, where the purge chamber 115 is split between both die blocks 103 and 104, and the empty cavity of the purge chamber 115 is located on the parting line of both die blocks 103 and 104, the empty cavity may act as a shock absorber of the force exerted by the injection plunger 112 as it sharply applies a given force to push the liquid metal 111 into the molding cavities 118. As this sharp and elevated force is applied, the excess liquid metal 111 will travel up the purge opening 116 into the purge chamber 115, harnessing and redirecting the exerted force, instead of resulting in the force pushing both of the die blocks 103 and 104 apart, where an additional shock absorber may be needed in the absence of the purge chamber 115 to absorb this force an avoid the possible resulting parting of the die blocks 103 and 104. The use of the purge chamber 115 as a shock absorber may be both effective and economical as the contaminants 110 are pushed into the purge chamber 115, and not in most part the liquid metal 111, to assist with the shock absorption. Conventional shock absorbing features may be situated tangentially to the die casted metal part at the end of the runners, at a further distance from the injection sleeve 101. Thus, having the purge chamber 115 function as a shock absorber allows for shorter runner length leading to the shock absorber, and a reduction in wasted liquid metal 111 caught in the runners 117. Moreover, the shorter distance between the shock absorber (purge chamber 115) and the injection site of the liquid metal 111 may allow for more effective shock absorption.

The runners 117 form channels communicating the liquid metal 111 from the injection sleeve 101 to the molding cavities 118 once the stopper 114 shifts to its second position, allowing for the flow of liquid metal 111. The runners 117 may be located on one of the die blocks 103 and 104, or both. In some examples, the runners 117 have a circular cross-sectional shape that are machined symmetrically in die blocks 103 and 104. In other examples, the runners 117 may be of a trapezoidal cross-sectional shape, machined in one of either die blocks 103 and 104.

An additional runner 131 may also connect the purge opening 116 to the purge chamber 115.

The die blocks 103 and 104 may also have alignment pins 123 for precision alignment of the fixed die block 103 to the ejection die block 104. As illustrated in FIG. 3, the alignment pins 123 may have a male part joined to one die block, and a female receiving part integrated on or onto the other die block.

As explained herein, at least a part of the molding cavities 118 may be also found on the fixed die block 103.

The Die Casting Insert:

In some embodiments, the die casting apparatus 100 may have a die casting insert 150 as shown in FIGS. 1, 2 and 3. The die casting insert 150 may be shaped to be fitted into the die casting apparatus 100. In some examples, the die casting insert 150 is shaped to be fitted into a cavity of the ejection die block 104. As shown in FIGS. 1 and 2, the die casting insert 150 may include certain components described herein as being part of the die casting apparatus 100. By fitting into the ejection die block 104 (or of the die blocks 103 and 104), the die casting insert 150 provides the die casting apparatus 100 with those components, as described below.

The die casting insert 150 has a stopper 114, a purge opening 116, an actuator 119, an outer casing 124, where the outer casing 124 may have the actuator casing 105. The die casting insert 150 may also include the pressure sensor 122 and the temperature sensor 120. The die casting insert 150 may also have a front fastening plate 127 as shown in FIGS. 1 and 3 (where, in some examples, the die casting insert 150 is inserted in the ejection die block 104 via the rear of the ejection die block 104, opposite to the parting line), the ejection die block 104 having a front cavity for receiving the front fastening plate 127 so the front fastening plate 127 inserted in the cavity of the ejection die block 104 is flush with the front surface of the ejection die block 104. The front cavity for receiving the fastening plate 127 may be of the same dimensions and depth as the fastening plate 127.

In some embodiments, the die casting insert 150 may have a rear fastening plate 128 as shown in FIG. 2 (where, in some examples, the die casting insert 150 is inserted in the ejection die block 104 via the front of the ejection die block 104, opposite to the parting line). The die casting insert 150 with a front fastening plate 127 may also have front fastening means 129 (e.g. screws, bolts, rivets) for fastening the front fastening plate 127 to the ejection die block 104. The die casting insert 150 with a front fastening plate 127 may also have rear fastening means for fastening the die casting insert 150 to the rear surface of the ejection die block 104 (not shown). The die casting insert 150 with a rear fastening plate 128 may also have rear fastening means (e.g. screws, bolts, rivets) for fastening the rear fastening plate 128 to the rear of the ejection die block 104 (not shown). The die casting insert 150 with a rear fastening plate 128 may also have front fastening means for fastening the die casting insert 150 to the front surface of the ejection die block 104 (not shown).

The outer casing 124 of the die casting insert 150 is shaped to encapsulate the components of the die casting insert 150 and may be shaped to fit into a corresponding receiving cavity in the ejection die block 104. In some other examples, the fastening plate (127 or 128), acting alone, may secure the die casting insert 150 to the ejection die block 104. In other examples, the shape of the outer casting 124 may be fitted to the ejection die block 124 and secures, alone or with the fastening plate 127 or 128, the die casting insert 150 to the ejection die block 104.

In the examples where an ejection die block 104 has a cavity to receive the die casting insert 150, the ejection die block 104 may not include the components contained in the die casting insert 105. As such, the functionality of the ejection die block 104 to produce die casted parts may require the integration of the die casting insert 150, the die casting insert 150 having, for example, the stopper 114 and its actuator 119. In these examples, the die casting insert 150 may be inserted into the ejection die block 104 through its front surface, the front surface of the ejection die block 104 forming the parting line with the fixed die block 103. In other examples, the die casting insert 150 may be inserted through the rear surface of the ejection die block 104 (e.g. when a rear fastening plate 128 is used). When inserted, the die casting insert 150 may travel the full width of the ejection die block 104, falling flush or protruding from the back wall of the ejection die block 104, its back wall diametrically opposite with its front wall. There may be a space between the back wall of the ejection die block 104 and the ejection plates 113 in which a portion of the die casting insert 150 (such as the portion including the actuator casing 105) may reside once inserted into the ejection die block 104.

The die casting insert 150 may also have a controller module 702 and an external input trigger 707 (or be connected to external input trigger 707) as described herein.

As the die casting insert 150 is separate from the ejection die block 104, it is possible to interchange the die casting insert 150 between ejection die blocks 104.

In alternative embodiments, the exemplary die casting apparatus 100 may be adapted for vertical die casting where the injection plunger applies lower pressure upon the contents of the inner hollow cavity of the injection sleeve.

Figure 5A:
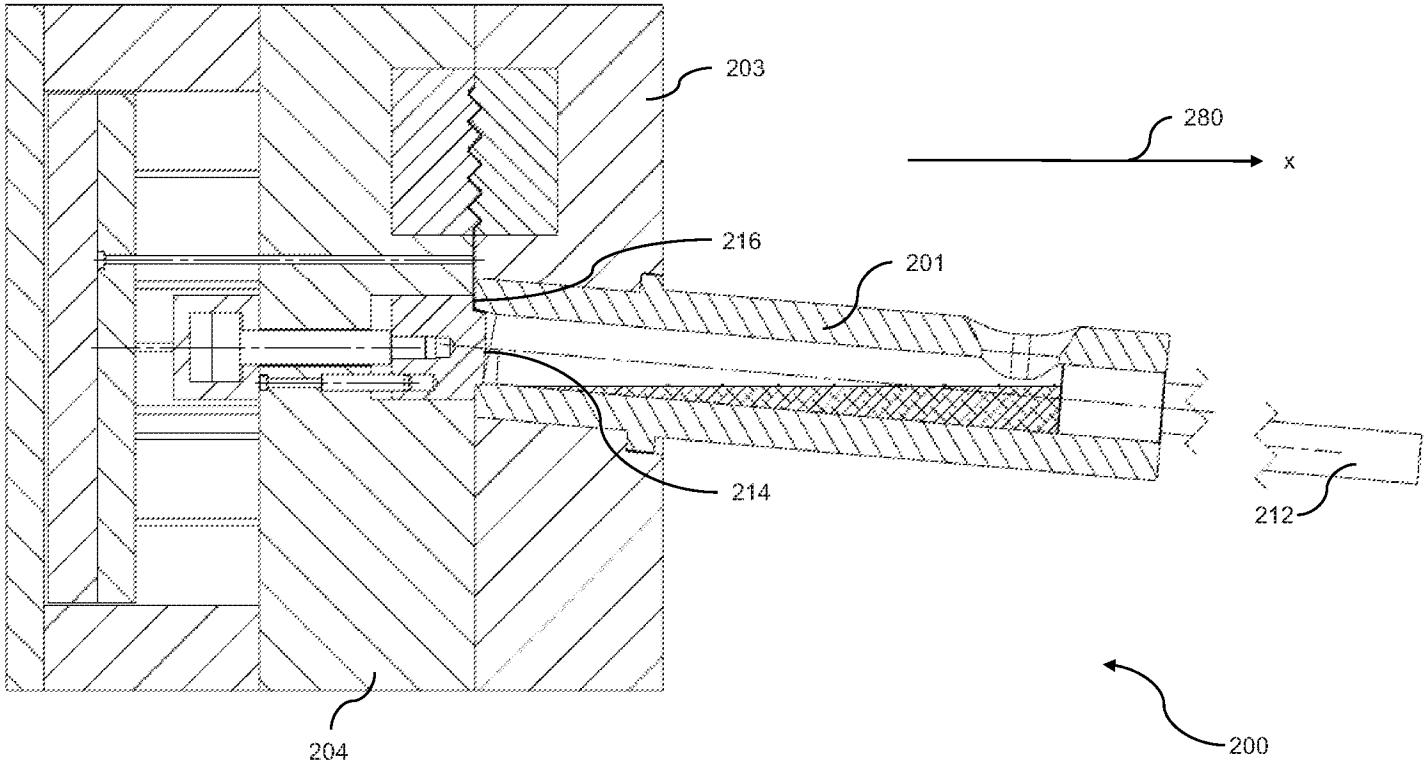
FIG. 5A is a side cross-sectional view of another exemplary die casting apparatus where the injection sleeve is angled downwards.

Variants of the Die Casting Apparatus:

Reference is now made to FIG. 5A, illustrating an exemplary die casting apparatus 200. The die casting apparatus 200 has an injection sleeve 201 tilted slightly downward with respect to the die casting blocks 203 and 204. In some embodiments, the angle of the injection sleeve 201 with respect to the x axis 280 may be of −5 degrees. The angle of the injection sleeve 201 may vary without departing from the present teachings. The slight angle of the injection sleeve 201 may allow the contaminants to pool with greater ease on a surface of the liquid metal for evacuation of the contaminants. As the injection plunger 212 pushes the liquid metal and the contaminants, while the injection plunger 212 moves into the injection sleeve 201, reducing the space occupied by liquid metal and the contaminants, the contaminants will be localized in a confined space near the purge opening 216, allowing for the extraction of the contaminants via the purge opening 216 while reducing the waste of liquid metal similarly expelled by the purge opening 216 during the extraction process.

In the example of FIG. 5A, the directing contour is at least at the same angle as that of the injection plunger 212.

Figure 5B:
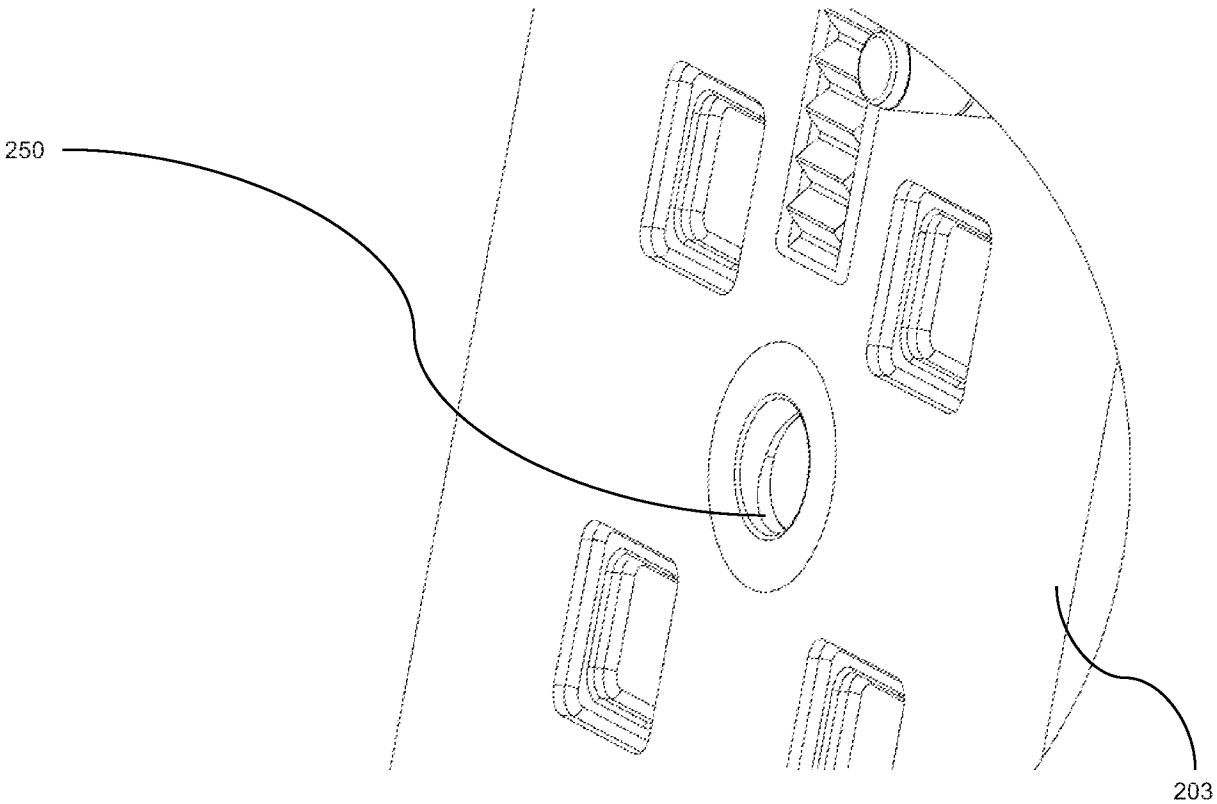
FIG. 5B is a close up perspective view of a fixed die block of an exemplary die casting apparatus where the injection sleeve is angled downwards.

In some examples, as shown in FIG. 5B, at least a portion of the stopper 214, and the corresponding portion of the injection sleeve 201, may have a release angle 250 to avoid locking the die blocks 203 and 204 as a result of solidification of residual metal during the die casting process. The release angle 250 may advantageously allow for the angled injection sleeve 201, where the die blocks 203 and 204 may remain in a horizontal position with respect to the x-axis 280.

In other embodiments, the entire die casting apparatus may be titled slightly downward with respect to the x-axis 280, where the injection sleeve of the die casting apparatus does not have an additional tilt with respect to the die blocks.

Figure 10:
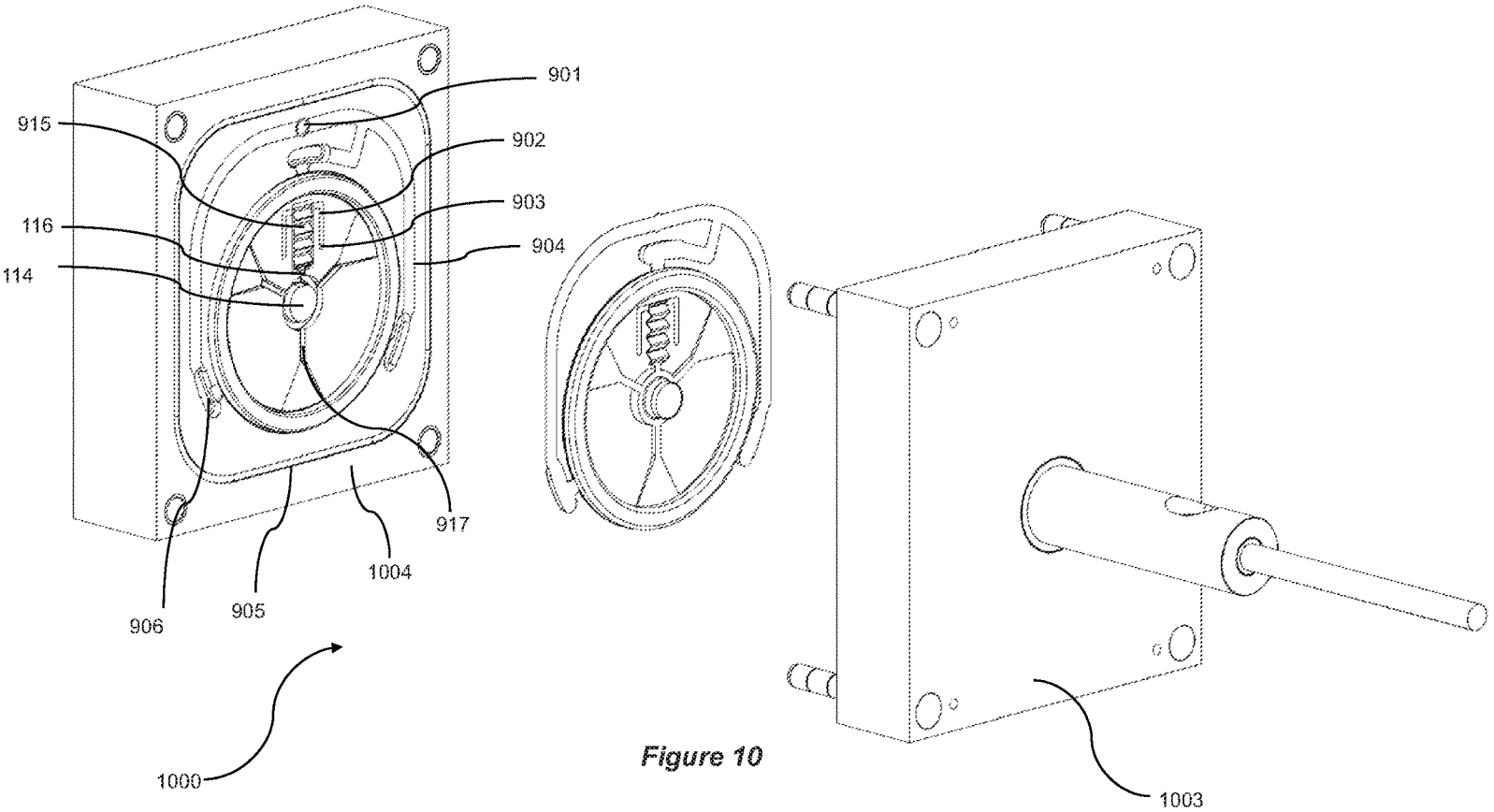
FIG. 10 is a side perspective view of an exemplary die casting apparatus using central injection with a purge opening connected to a purge chamber.

In some examples, as illustrated in FIG. 10, the die casting apparatus may be adapted for central injection die casting (used, for instance, for manufacturing large die casted parts where the liquid metal 111 is injected in a location that is central with respect to the die casted part), where a stopper in at least one configuration provides a seal-off surface with the injection sleeve as described herein, except for a purge opening allowing for the evacuation of contaminants into, for instance, a purge chamber. Traditionally, in central injection die casting, the contaminants (including the air) are expelled via overflow chambers connected to the molding cavities, in turn connected to a vacuum device. The contaminants are pushed or sucked through the runners and the molding cavities, into the overflows, before expulsion. As the contaminants are pulled through, this requires a greater vacuum. Moreover, this traditional configuration leads to the waste of excess metal in the runners as the liquid metal assists with pushing the contaminants towards their evacuation points. In contrast, the die casting apparatus 1000 allows for the evacuation of contaminants 110 into a purge chamber 915 via a purge opening 116 before injecting the liquid metal 111 into the molding cavities, where the contaminants 110 travel a separate path to their point of expulsion than the path followed by the liquid metal 111 for injecting. Therefore, the path followed by the contaminants 110 to their expulsion point is shorter, needing a lesser vacuum for their expulsion, and where the liquid metal 111 is no longer used to push the contaminants 110 out via the runners 917.

The die casting apparatus 1000 has namely a stopper 114 with a purge opening 116 for evacuating contaminants into a purge chamber 915 connected to the purge opening 116 the expulsion of the contaminants 110 occurring prior to the injecting of the liquid metal 111 into the molding cavities. The purge chamber 915 may also be connected to purge chamber vent channels 902 having purge chamber vacuum valve cavities 903 for connecting to a vacuum valve (e.g. a vacuum poppet valve), mounted to or integrated onto the die blocks 1003 or 1004, for connecting to a vacuum mechanism as is known in the art and assisting with the expulsion of the contaminants, including the trapped air. For instance, the air in the injection sleeve may be evacuated from the hollow inner cavity of the injection sleeve through the purge chamber vacuum valve cavities 903 before the contaminants 110 and liquid metal 111 leave the injection sleeve.

The casting apparatus 1000 may also have cavity vent channels 904 connected to overflows 906 (i.e. that may receive excess liquid metal 111 flowing from the molding cavities) and to at least one vacuum valve cavity 901 for connecting to a vacuum mechanism as is known in the art, via a vacuum valve. In some embodiments, the vacuum valve, for connecting to the vacuum valve cavity 901, can be integrated in the die blocks 1003 and/or 1004. In other embodiments, the vacuum valve may be mounted on the outside of the die blocks 1003 and/or 1004.

The vacuum valve for connecting to the vacuum valve cavity 901 and/or the vacuum valve for connecting to the purge chamber vacuum valve cavity 903 may be an air poppet valve (connected to via a "chicane type" or baffle channel) or may be a needle pin based vacuum valve located in the fixed die block 1003 structured for self-cleaning to avoid clogging of the vacuum valve.

The die casting apparatus 1000 may also have a parting line surface seal 905 for maintaining a seal when a vacuum has been achieved, the vacuum created within the molding cavities and other compartments in which the liquid metal 111 and/or contaminants 110 may flow.

The exemplary die casting apparatus 1000 provides the advantage of shorter runners 917 communicating the liquid metal 111 from the injection sleeve to the molding cavities than in traditional central injection die casting machines as the contaminants 110 are first purged via the purge chamber 915 before the liquid metal 111 is injected into the molding cavities. As the runners 917 are shorter, less metal 111 is wasted in the runners.

In some embodiments, the die casting apparatus 1000 may be adapted for double barrel injecting, incorporating the use of a stopper with a purge opening leading to a purge chamber as is described herein.

In other embodiments, the exemplary die casting apparatus may be adapted for three plate die casting as further described in US patent application No. 2014/0219862, where shorter runner length may be used as a result of the integration of a stopper with a purge opening leading to a purge chamber as are described herein, as the contaminants are expelled before the injecting of the liquid metal 111.

Die Casting Controller:

The die casting insert 150 may also be connected to a die casting controller 700. The die casting controller 700 may have a controller module 702, for example a processor, FPGA or dedicated circuitry. The die casting controller 700 may have or may be connected to a pressure sensor 122 and a temperature sensor 120. The die casting controller 700 may have a wireless interface 703, an external trigger input 707 configured to receive a signal to activate the actuator mechanism for shifting the stopper 114 between the first and second positions. The die casting controller 700 may also have non-volatile memory 705 configured to store information on commanding the die casting insert 150, including information on the use of the die casting insert 150. The die casting controller 700 may also have or be connected to the actuator 119.

The controller module 702 is configured to regulate or monitor the functioning of the stopper 114 based on the command information stored in the non-volatile memory 705 related to allowing the die casting insert 150 to run, as well as input received via the external trigger input 707. The controller module 702 may regulate the shifting of the stopper 114 from the first position to the second position via, for instance, the actuator 119. The controller module 702 may also receive information on the shifting of the stopper 114 from its first position to its second position using an encoder. The controller module 702 receives input via, for example, the external trigger input 707, to activate the die casting insert, more specifically the motion of the stopper 114 from its first to its second position. The controller module 702 processes the external input in light of the command information stored in the non-volatile memory 705. The controller module 702 may then transmit a signal to the actuator 119 to engage the shifting of the stopper 114 between its first and second positions. The controller module 702 may be a microprocessor connected via a bus to the non-volatile memory 705.

The optional external trigger input 707 may be a connected to the controller module through wired connection, or to the input signal through a wired connection, receiving a signal or a trigger indicating to shift the stopper 114 from its first position to its second position to allow the liquid metal 111, now substantially without the contaminants 110 that have been expelled through the purge opening 116, to pour into the molding cavities 118. In some examples, the signal or trigger to shift the stopper 114 from its first position to its second position may be sent wireless and received via the wireless interface 703.

The controller module 702 may be configured to obtain information whenever the actuator 119 shifts the stopper 114 from its first to its second position. In other embodiments, the controller module 702 may command the actuator 119 to shift the stopper 114 from its first to its second positions.

For instance, the controller module 702 may receive wirelessly via the wireless interface 703 a number of authorized uses of the die casting insert 150. The number of authorized uses is transmitted from the wireless interface 703 to the controller module 702 and then stored as data in non-volatile memory 705 as, for example, a decreasing counter, the initial value of the decreasing counter equaling the number of authorized uses. Each time the controller module 702 receives input, for instance via the external tripper input 707, from an encoder connected to the stopper 114, the pressure sensor 120 or temperature sensor 122, to activate the stopper 114, the controller module 702 may retrieve from memory the counter information to verify if there are remaining authorized available uses. If there are authorized available uses, the controller module 702 may decrease the counter of authorized uses stored in memory by 1. The controller module 702 may also activate the actuator 119, permitting the actuator 119 to shift the stopper 114 from its first position to its second position.

In other examples, the controller module 702 may instead react passively to the engaging of the actuator 119 when the stopper 114 shifts from its first position to its second position. For instance, whenever the actuator 119 triggers a shift of the stopper 114, the controller module 702 may register this shift. The controller module 702 may then retrieve an incremental counter from the non-volatile memory 705, and increase the counter by one, storing the new value for the incremental counter in the non-volatile memory 705. In these examples, the incremental counter registers the number of uses of the actuator 119 or stopper 114 mechanism, indicating the number of times the die casting insert 150 has been used for a die casting process.

The above serve as only examples of how the die casting controller 700 may regulate and monitor the use of the die casting insert 150. Other variations may be permitted without departing from the present teachings.

The wireless interface 703 may act either or both as a wireless transmitter or wireless receiver.

In these embodiments, the counter information stored in non-volatile memory 705 may be retrieved and accessed remotely by an intended user of the die casting insert 150, or by a third party (e.g. a third party licenser) desiring, for example, to obtain information of the use of the die casting insert 150, via for instance the wireless interface 703. The intended user may also increase the amount of authorized uses such as by using a remote computer (e.g. a tablet or smartphone), the remote computer communicating with the wireless interface 703, sending information the authorized uses to the die casting controller 700 via the wireless interface 703.

It will be appreciated that non-volatile memory 705 can store counts for authorized uses in different accounts associated with different clients or applications. When a die caster is manufacturing parts for a client, the insert 700 could be commanded using an interface connected to the die casting insert 150 (such as a smartphone app connected to the die casting insert 150 via a Bluetooth connection 703) to begin using the client's account. Communication between an interface program or app of a computer having an Internet connection and an account server also connected to the Internet can allow the credits to be obtained from the client's account or from an account of the die caster. When the credits are obtained from the client's account, the die caster need not be concerned with reimbursement from the client for credits used.

For security, the controller module 702 (e.g. processor) can use encryption (for example asymmetric key encryption) to securely obtain from the account server the credits to be stored in non-volatile memory 705.

In some embodiments, when the power is cut from the die casting insert 150, the die casting controller 700 may lock the stopper 114 in the second position. In other examples, when the number of available uses, as saved in the non-volatile memory 705 reaches zero, the die casting controller 700 may also lock the stopper 114 in the second position. When the stopper 114 is actuated by injection sleeve pressure and actuator 119 is a spring or source of bias, then a locking mechanism, such as a solenoid actuated pin, can be used to lock the stopper 114.

The pressure sensor 122 may also communicate pressure readings of the die casting insert 150 or die casting apparatus 100 to the controller module 702. The controller module 702 may then store the pressure readings in the non-volatile memory 705 or send the pressure readings to a remote user or remote computer via, for instance, the wireless interface 703.

The temperature sensor 120 may also communicate temperature readings of the die casting insert 150 or die casting apparatus 100 to the controller module 702. The controller module 702 may then store the temperature readings in the non-volatile memory 705 or send the temperature readings to a remote user or remote computer via, for instance, the wireless interface 703.

Figure 6:
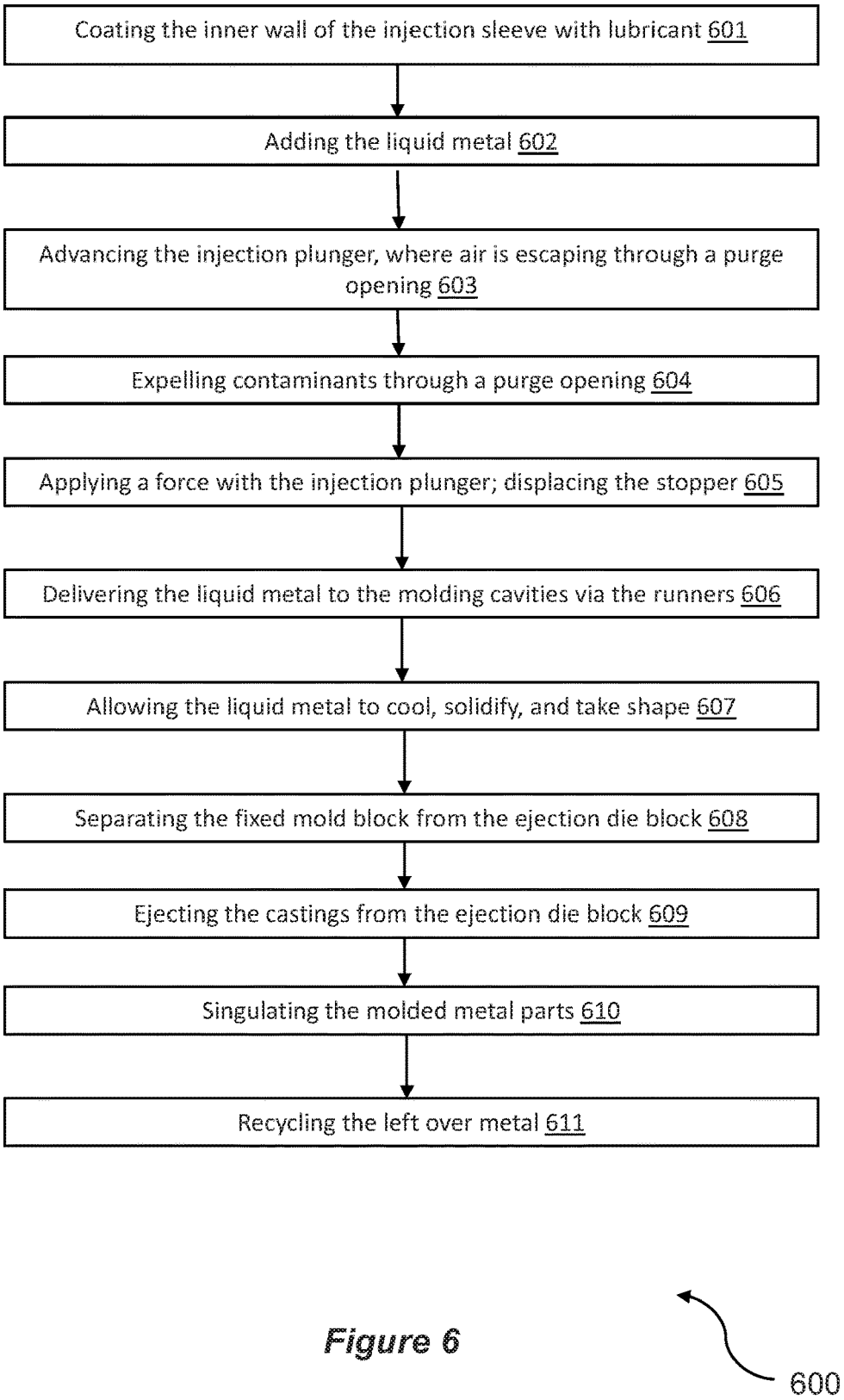
FIG. 6 is a flowchart of an exemplary method for producing die casted parts using a die casting apparatus that purges contaminants located on the surface of the liquid metal.

Method of Producing a Die Casted Part:

Reference is now made to FIG. 6, illustrating an exemplary method of producing a die casted part 600 using an exemplary die casting apparatus. The die casting apparatus of the method 600 has a fixed die block and a mobile die block and molding cavities in at least one of the die blocks. The die casting apparatus of method 600 also has an injection sleeve joined to the fixed die block with a hollow inner cavity for receiving liquid metal, an injection plunger fitted to the hollow inner cavity for applying pressure to the liquid metal. The die casting apparatus of method 600 also has a stopper fitted to mate with the hollow inner cavity and to seal the hollow inner cavity except for a purge opening structured to evacuate contaminants topping the liquid metal.

The inner wall of the injection sleeve is first coated with a lubricant at step 601. The lubricant is added to prevent the liquid metal from sticking to the inner walls of the injection sleeve. The lubricant may be a water based lubricant or an oil based lubricant. In some examples, the quantity of lubricant added is sufficient to coat the entirety of the inner wall of the injection sleeve. There may be some excess lubricant that pools in the inner cavity of the injection sleeve.

The molten liquid metal is then poured into the injection sleeve at step 602 through a fill port located on the injection sleeve. The liquid metal then remains in the inner cavity of the injection sleeve. The excess lubricant may migrate to the top of the liquid metal body. Particulates may also mix with the lubricant and rest in the same top layer, above the liquid metal. This layer of lubricant, particulates and other impurities, are considered contaminants that may mix with the liquid metal. The layer of contaminants is preferably evacuated before injecting the liquid metal into the molding cavities in order for the contaminants to not mix with the liquid metal before solidifying and taking shape into the die casted parts.

A first pressure is then applied onto the liquid metal in the injection sleeve. For instance, the injection plunger may be advanced to exert pressure onto the liquid metal, where the injection plunger may block the fill port, air no longer able to escape through the fill port. The pressure exerted by the injection plunger is sufficient to allow excess air to escape through the purge opening as the pressure in the injection sleeve increases at step 603. The purge opening may be located at the top of the stopper.

The contaminants on top of the liquid metal, or a significant portion thereof, are then expelled from the purge opening as a result of the applied pressure at step 604, leaving substantially all of the liquid metal in the inner cavity of the injection sleeve. Other forms of pressure, such as a pulling or suction force, may be applied to the contents of the injection sleeve for expelling the contaminants than using the pushing force of the injection plunger. The contaminants may flow from the purge opening via a runner into a purge chamber for containing and/or trapping the contaminants, the purge chamber located, for instance, in one or both of die blocks.

The injection plunger then applies a second force to the liquid metal 111. The stopper may shift from a first to a second position as a result of the application of the second force (e.g. pushed back to the second position in reaction to the second force), or the displacement of the stopper may occur as a result of a mechanical, manual or electric input provided linked, or independent of the second applied force at step 605. For instance, the stopper may respond to user input. In these examples, once the stopper has shifted from the first position to the second position, then the injection plunger applies the second force to the liquid metal. In its first position, the stopper seals off the injection sleeve (except for the portion at the purge opening). In the second position, the stopper (in combination with or without the directing contour) allows for the flow of the liquid metal out of the injection sleeve, and in some embodiments, into the molding cavities via the runners. The second force may be an abrupt hammering action or shot, the hammering causing a sharp discharge of force causing the liquid metal to push on the stopper, the pushing of the liquid metal sufficient to trigger a shift of the stopper from its first position to its second position. In the examples where the stopper is held in place by a force of a resistive mechanism, such as a spring mechanism, the second force applied by the injection plunger is sufficient to counter the resistive force of the resistive mechanism maintaining the stopper in place in the second position. The stopper may also be held in placed using an actuator mechanism or engaging mechanism, reacting to a sufficient application of force by the liquid metal under pressure from the hammering force of the injection sleeve or an external trigger, such as user input or an electric signal transmitted, for instance, via a wired connection to a controller module. In other embodiments, the second force driving the movement of the liquid metal into the molding cavities may be a vacuum or suction force. The vacuum or suction force may also, in some embodiments, assist with the movement of the liquid metal from the injection sleeve into the molding cavities.

In an example where the ejection die block includes a die casting insert, the stopper may also be connected to a controller, such as the die casting controller 700 as illustrated in FIG. 7, measuring the number of uses of the stopper mechanism, the shifting of the stopper from the first position to the second position. For instance, the die casting controller may store in memory a number of allowable uses, and each time the stopper shifts from the first position to the second position, the number of allowable uses is decreased by one. In other examples, the die casting controller may store in memory counter information, where every time the stopper shifts from the first position to the second position, or each time the actuator is engaged to shift the stopper between the first position and the second position, the counter stored in the die casting controller's memory is increased by one.

Once the stopper shifts to its second position, the opening resulting from the stopper's shift allows the liquid metal to flow from the inner cavity of the injection sleeve to the runners connected to the molding cavities (in some embodiments directed by the directing contour), the runners delivering the liquid metal to the molding cavities at step 606. When the liquid metal has been delivered to the molding cavities, the stopper may shift back from the second position to the first position (e.g. because a sufficient force is no longer exerted by the liquid metal onto the stopper to counter the spring mechanism, or the actuator mechanism tied to the stopper positions triggers the shift). In other examples, the stopper may shift back from the second position to the first position only at the end of the die casting process, once the die casting parts have been removed from the ejection die block. The shifting of the stopper back to the first position may be tin response to a trigger, for example, by a form of manual input, an electric signal, or at the expiration of the timer. The shifting of the stopper back to the first position may be performed, for example, manually (e.g. a user pushing the stopper back to its first position) or mechanically (a mechanism causing the stopper to shift back to the first position).

Once the liquid metal is delivered to the molding cavities, the liquid metal is allowed to cool and solidify at step 607, taking the shape of the molding cavities. A temperature sensor, for instance, may be used, to measure or approximate the temperature of metal inside the molding cavities, allowing a user to determine when the solidification of the die casted parts is complete or near completion.

The fixed die block is then separated from the ejection die block at step 608. The castings found in the molding cavities may remain in the ejection die block. The ejection die block then may use the ejection pins, with the ejection plates, to expel the castings from the molding cavities at step 609.

The castings are then singularized, yielding the desired molded die casted parts at step 610.

Solidified liquid metal remaining in the runners, the injection sleeve, the purge opening and other components of the die casting apparatus may be separated, preserved, and later recycled for future die casting at step 611. Moreover, as the contaminants may be collected in the purge chamber, they may be collected separately from the recycled solidified liquid metal, allowing for the disposal of the contaminants while recycling the solidified metal.

The description of the present invention has been presented for purposes of illustration but is not intended to be exhaustive or limited to the disclosed embodiments. Many modifications and variations will be apparent to those of ordinary skill in the art.

What is claimed is:

1. A die casting insert adapted to fit into one of an ejection die block and a fixed die block of a die casting apparatus for producing die casted metal parts from liquid metal, wherein said die casting apparatus comprises said fixed die block and said ejection die block, an injection sleeve joined to said fixed die block with a hollow inner cavity for receiving said liquid metal, an injection plunger fitted to said hollow inner cavity for applying pressure to said liquid metal in said hollow inner cavity of said injection sleeve, and molding cavities with at least one runner connected thereto, said die casting insert comprising:

a fastening for securing said insert to one of said ejection die block and said fixed die block;

a stopper with a purge opening at a top of said stopper, said stopper comprising:

a cylindrical portion with a first base and a second base opposite said first base; and a frustoconical portion projecting from said second base of said cylindrical portion, wherein said frustoconical portion defines an annular mating surface on said second base of said cylindrical portion;

said stopper fitted to mate with said hollow inner cavity of said injection sleeve, being constructed:

to seal said hollow inner cavity of said injection sleeve except at said purge opening when in a first position; and to permit the flow of said liquid metal from said hollow inner cavity of said injection sleeve when said stopper is in a second position; and an actuator comprising a shaft that is connected to said first base of said cylindrical portion of said stopper configured to shift said stopper between said first position and said second position.

2. The die casting insert of claim 1, further comprising a fastening plate, wherein at least one of said fastening plate and said outer casing fits and secures the die casting insert to said one of said ejection die block and said fixed die block.

3. The die casting insert of claim 2, wherein said fastening plate is structured to be fastened to a fastening cavity on a rear surface of said one of said ejection die block and said fixed die block, said rear surface of said one of said ejection die block and said fixed die block being opposite to a surface of said one of said ejection die block and said fixed die block adapted to form a parting line with a front surface of the other one of said ejection die block and said fixed die block, and said die casting insert further comprising a directing contour surrounding said stopper adapted to direct the flow of said liquid metal to said runners when said stopper is in said second position.

4. The die casting insert of claim 1, wherein said purge opening is shaped to connect with a purge chamber via a runner communicating with said purge chamber, wherein said contaminants are allowed to flow from said purge opening to said purge chamber through said runner.

5. The die casting insert of claim 1, wherein said activation mechanism is an actuator configured to engage the shifting of said stopper between said first position and said second position.

6. The die casting insert of claim 5, wherein said actuator is configured to respond to user input to engage the shifting of said stopper between said first position and said second position.

7. The die casting insert as defined in claim 1, wherein said stopper undergoes a rotation when shifting from said first position to said second position.

8. A die casting insert adapted to fit into one of an ejection die block and a fixed die block of a die casting apparatus for producing die casted metal parts from liquid metal, wherein said die casting apparatus comprises said fixed die block and said ejection die block, an injection sleeve joined to said fixed die block with a hollow inner cavity for receiving said liquid metal, an injection plunger fitted to said hollow inner cavity for applying pressure to said liquid metal in said hollow inner cavity of said injection sleeve, and molding cavities with at least one runner connected thereto, said die casting insert comprising:

a fastening configured to secure said insert to one of said ejection die block and said fixed die block;

a stopper comprising:

a purge opening;

a cylindrical portion with a first base and a second base opposite said first base; and a frustoconical portion projecting from said second base of said cylindrical portion, wherein said frustoconical portion defines an annular mating surface on said second base of said cylindrical portion, said purge opening present on said mating surface; and an actuator adapted to shift said stopper between first and second positions, wherein:

in said first position, said stopper seals said hollow inner cavity of said injection sleeve except at said purge opening; and in said second position, said stopper permits flow of said liquid metal from said hollow inner cavity of said injection sleeve.

9. A die casting insert adapted to fit into one of an ejection die block and a fixed die block of a die casting apparatus for producing die casted metal parts from liquid metal, wherein said die casting apparatus comprises said fixed die block and said ejection die block, an injection sleeve joined to said fixed die block with a hollow inner cavity for receiving said liquid metal, an injection plunger fitted to said hollow inner cavity for applying pressure to said liquid metal in said hollow inner cavity of said injection sleeve, and molding cavities with at least one runner connected thereto, said die casting insert comprising:

a stopper comprising a purge opening located at the top of said stopper, said stopper comprising:

a cylindrical portion with a first base and a second base opposite said first base; and a frustoconical portion projecting from said second base of said cylindrical portion, wherein said frustoconical portion defines an annular mating surface on said second base of said cylindrical portion, said purge opening present on said mating surface;

an actuator comprising a shaft connected to said stopper, configured to shift said stopper between two positions:

in said first position, said stopper seals said hollow inner cavity of said injection sleeve except at said purge opening for evacuating said impurities from said hollow inner cavity; and in said second position, said stopper permits flow of said liquid metal from said hollow inner cavity of said injection sleeve; and a casing comprising an inner space configured to receive said stopper;

wherein said shaft has a range of movement that confines said stopper to said inner space of said outer casing such that said stopper is at least partially seated in said inner space of said outer casing in said first position and said second position, and said stopper is protruding from said inner space in said first position.

10. The die casting insert as defined in claim 9, wherein said stopper undergoes a rotation when shifting from said first position to said second position.

* * * * *